US010001751B2

(12) United States Patent
Jung et al.

(10) Patent No.: US 10,001,751 B2
(45) Date of Patent: Jun. 19, 2018

(54) ELECTRONIC DEVICE INCLUDING ROTATABLE ANNULAR MEMBER

(71) Applicant: SAMSUNG ELECTRONICS CO., LTD., Suwon-si, Gyeonggi-do (KR)

(72) Inventors: Wook-Dam Jung, Suwon-si (KR); Yongcheon Kang, Yongin-si (KR); Dong-Jin Yim, Suwon-si (KR); Hyun-Seok Chang, Seoul (KR); Sanghyuck Jung, Hwaseong-si (KR); Jeongeun Kim, Suwon-si (KR); Byoung-Uk Yoon, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days. days.

(21) Appl. No.: 15/373,008

(22) Filed: Dec. 8, 2016

(65) Prior Publication Data

US 2017/0277125 A1 Sep. 28, 2017

(30) Foreign Application Priority Data

Mar. 25, 2016 (KR) ..... 10-2016-0035894

(51) Int. Cl.
*G04B 19/28* (2006.01)
*G04G 21/00* (2010.01)
(Continued)

(52) U.S. Cl.
CPC ..... *G04B 19/283* (2013.01); *G04C 3/004* (2013.01); *G04G 17/04* (2013.01); *G04G 21/00* (2013.01)

(58) Field of Classification Search
CPC ..... G04B 19/28; G04B 19/283; G06F 3/0362; G06F 3/02; G06F 1/163; G06F 3/0312; G04C 3/005; H04B 1/3833
(Continued)

(56) References Cited

U.S. PATENT DOCUMENTS 9,760,064 B2 * 9/2017 Kim ..... G04G 21/00
2005/0007890 A1 * 1/2005 Bertrand ..... G04B 19/28 368/294
(Continued)

FOREIGN PATENT DOCUMENTS

JP 2010-185833 8/2010
KR 10-2016-0105016 9/2016

OTHER PUBLICATIONS

"GEAR S2", http://www.samsung.com/us/search/searchMain?Dy=&Nty=&Ntt=GEAR+S2, retrieved Oct. 21, 2016, 6 pages.

*Primary Examiner* — Edwin A. Leon
(74) *Attorney, Agent, or Firm* — Nixon & Vanderhye P.C.

(57) ABSTRACT

Various example embodiments of the present disclosure provide an electronic device including: a housing including a substantially circular opening and a first surface facing in a first direction; a wearing structure configured to enable the electronic device to be removably worn on a part of a human body and connected to the housing; a display disposed in the opening; an annulus installed on the first surface and configured to be rotatable along a periphery of the opining, the annulus including a second surface facing a second direction opposite the first direction; at least one spacer interposed between a part of the first surface and the second surface of the annulus; and a circuit configured to detect a rotation of the annular member and to change the display at least in part based on the rotation.

19 Claims, 26 Drawing Sheets

(51) Int. Cl.
*G04G 17/04* (2006.01)
*G04C 3/00* (2006.01)

(58) Field of Classification Search
USPC ..... 368/294–295
See application file for complete search history.

(56) References Cited

U.S. PATENT DOCUMENTS

| | | | | |
|---|---|---|---|---|
| 2010/0220560 | A1 | 9/2010 | Hiranuma et al. | |
| 2015/0338828 | A1 | 11/2015 | Behra et al. | |
| 2016/0252888 | A1 | 9/2016 | Kim et al. | |
| 2016/0252980 | A1* | 9/2016 | Park | G06F 3/0362 345/184 |
| 2016/0327916 | A1* | 11/2016 | Kim | G06F 3/0362 |

* cited by examiner

ELECTRONIC DEVICE INCLUDING ROTATABLE ANNULAR MEMBER

CROSS REFERENCE TO RELATED APPLICATION

The present application is based on and claims priority under 35 U.S.C. § 119 to an application filed in the Korean Intellectual Property Office on Mar. 25, 2016 and assigned Serial No. 10-2016-0035894, the disclosure of which is incorporated by reference herein in its entirety.

BACKGROUND

1. Technical Field

The present disclosure relates generally to an electronic device including a rotatable annular member (e.g., an annulus).

2. Description of Related Art

Thanks to the recent development of electronic devices, the electronic devices are applied to various fields closely associated with our life. In particular, portable devices have become the most essential items in our life from among the electronic devices.

These electronic devices are released with various sizes and shapes according to their respective functions and users' preference. Therefore, users are interested in the external appearance of electronic devices as well as the functions and slim shapes of the devices, and electronic devices which have good and attractive designs are more preferred by users even if they have the substantially same functions as the devices of other companies.

In particular, wearable devices have limited sizes so as to be worn on users' bodies, but are competing for their abilities to efficiently perform various functions in the limited sizes.

SUMMARY

A wearable electronic device may include an annular member (for example, an annulus in the form of, for example, a rotary wheel, a rotatable stem, or the like) which is rotatably disposed on at least a part of a housing. According to an example embodiment, the electronic device may output a corresponding function based on a rotation parameter (for example, a rotation direction, a rotation speed, an amount of rotation, a rotated location, or the like) which is detected based on the rotation of the annular member. However, the annular member may be insufficient to provide a click sense to a user based on the rotation, and, when the annular member is used for long time, there may be dust due to abrasion caused by friction between the annular member and the housing and thus a rotation sense may be reduced. In addition, it may be difficult to handle the annular member.

An example aspect of the present disclosure is to address at least the above-mentioned problems and/or disadvantages and to provide at least the advantages described below. Accordingly, an example aspect of the present disclosure provides an electronic device including a rotatable annular member.

An example aspect of the present disclosure also provides an electronic device including a rotatable annular member, which ensures high operation reliability even when it is used for long time.

An example aspect of the present disclosure also provides an electronic device including a rotatable annular member which is configured to provide a good rotation sense and click sense to a user.

According to an example aspect of the present disclosure, an electronic device includes: a housing including a substantially circular opening and a first surface facing in a first direction; a connection member or wearing structure comprising connection elements configured to allow the electronic device to be removably worn on a part of a human body and to be connected to the housing; a display disposed in the opening; an annular member installed on the first surface of the housing and configured to be rotatable along a periphery of the opening, the annular member including a second surface facing in a second direction opposite to the first direction; at least one spacer interposed between a part of the first surface of the housing and the second surface of the annular member; and a circuit configured to detect a rotation of the annular member and to change the display based on the rotation.

According to another example aspect of the present disclosure, an electronic device includes: a housing including a substantially circular opening and a first surface facing in a first direction; an annular member disposed on the first surface of the housing and configured to be rotatable along a periphery of the opening, the annular member including a second surface facing in a second direction opposite to the first direction; an interface fixed along the periphery of the opening of the housing and configured to regulate the annular member to be rotatable; at least one spacer fixed to a part of the first surface of the housing and is brought into contact with the second surface of the annular member; a plurality of magnetic elements which face the second surface and are arranged at regular intervals along a first surface of the annular member facing in the first direction; a sensor module comprising at least one sensor, the sensor module being disposed in the opening of the housing and configured to detect a magnetic force of the magnetic element based on a rotation of the annular member; and at least one processor functionally connected with the sensor module, and configured to output a corresponding function based on a rotation parameter provided by the sensor module and detected based on the rotation of the annular member.

BRIEF DESCRIPTION OF THE DRAWINGS

The above and other aspects and features of the present disclosure will become more apparent from the following detailed description, taken in conjunction with the accompanying drawings, in which like reference numerals refer to like elements, and wherein.

DETAILED DESCRIPTION

Figure 1:
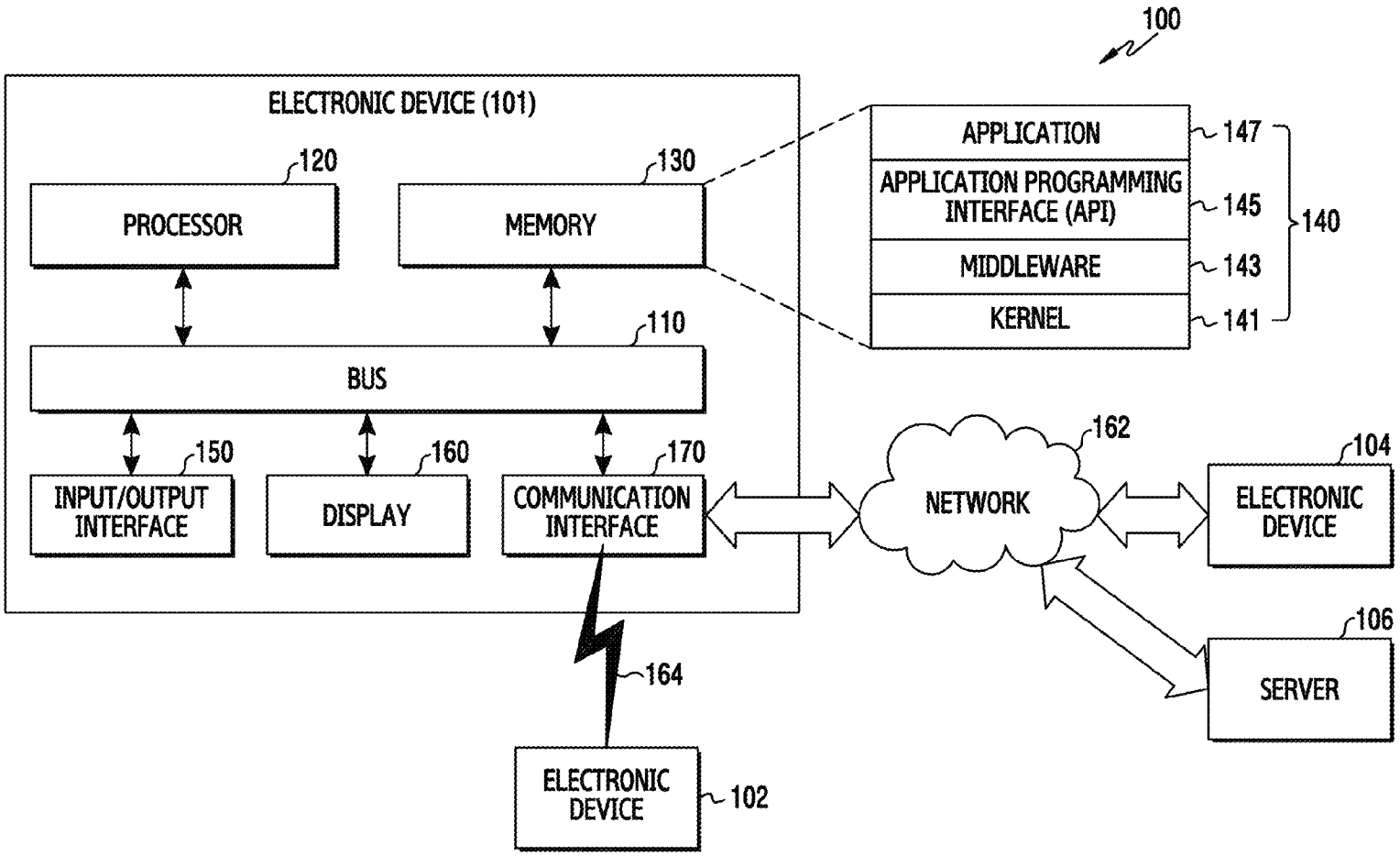
FIG. 1 is a diagram illustrating an example network environment including an electronic device according to various example embodiments of the present disclosure.

The following description, with reference to the accompanying drawings, is provided to aid in understanding of example embodiments of the present disclosure. Those of ordinary skill in the art will recognize that various changes and modifications of the embodiments described herein can be made without departing from the scope and spirit of the present disclosure. In addition, descriptions of well-known functions and constructions may be omitted for the sake of clarity and conciseness.

The terms and words used in the following description and claims are not limited to their dictionary meanings, but are merely used to enable a clear and consistent understanding of the present disclosure. Accordingly, it should be apparent to those skilled in the art that the following description of embodiments of the present disclosure is provided for illustrative purposes only and not for the purpose of limiting the present disclosure as defined by the appended claims and their equivalents.

It is to be understood that the singular terms "a," "an," and "the" include plural references unless the context clearly dictates otherwise. Thus, for example, reference to "a component surface" includes reference to one or more of such surfaces.

The embodiments used to describe the principles of the present disclosure are by way of illustration only and should not be construed in any way to limit the scope of the disclosure. Those skilled in the art will understand that the principles of the present disclosure may be implemented in any suitably arranged electronic device.

By the term "substantially" it is meant that the recited characteristic, parameter, or value need not be achieved exactly, but that variations such as tolerances, measurement errors, measurement accuracy limitations and other factors known to those of skill in the art, may occur in amounts that do not preclude the effect the characteristic was intended to provide.

The terms "include" and "may include" used herein are intended to indicate the presence of a corresponding function, operation, or constitutional element disclosed herein, and are not intended to limit the presence of one or more functions, operations, or constitutional elements. In addition, the terms "include" and "have" are intended to indicate that characteristics, numbers, operations, constitutional elements, and elements disclosed in the description or combinations thereof exist. However, additional possibilities of one or more other characteristics, numbers, operations, constitutional elements, elements or combinations thereof may exist.

As used herein, the expression "or" includes any and all combinations of words enumerated together. For example, "A or B" may include either A or B, or may include both A and B.

Although expressions used in embodiments of the present disclosure, such as "1st", "2nd", "first", "second" may be used to express various constituent elements of the embodiments of the present disclosure, these expressions are not intended to limit the corresponding constituent elements. The above expressions are not intended to limit an order or an importance of the corresponding constituent elements, and may be used to distinguish one constituent element from another constituent element. For example, a first user device and the second user device are both user devices, and indicate different user devices. Similarly, a first constituent element may be referred to as a second constituent element, and the second constituent element may be referred to as the first constituent element without departing from the scope of the present disclosure.

When an element is mentioned as being "connected" to or "accessing" another element, this may indicate that the element is directly connected to or accessing the other element, or there may be intervening elements present between the two elements. When an element is mentioned as being "directly connected" to or "directly accessing" another element, it is to be understood that there are no intervening elements present.

The term "module" as used herein may refer, for example, to a unit including one of hardware (e.g., electrical circuitry and/or mechanical elements), software, and firmware, or a combination thereof. The term "module" may be interchangeably used with terms, such as unit, logic, logical block, component, or circuit. A module as described herein may be a minimum unit of an integrally constituted component or may be a part thereof. The module may be a minimum unit for performing one or more functions or may be a part thereof. The module may be mechanically or electrically implemented. For example, the module as described herein includes at least one of processing circuitry an application-specific integrated circuit (ASIC) chip, field-programmable gate arrays (FPGAs), and a programmable-logic device, which are known or will be developed and which perform certain operations.

Unless otherwise defined, all terms, including technical and scientific terms, used herein have the same meaning as commonly understood by those of ordinary skill in the art to which embodiments of the present disclosure pertain. It will be further understood that terms, such as those defined in commonly used dictionaries, should be interpreted as having meanings that are consistent with their meaning in the context of the relevant art and the embodiments of the present disclosure, and should not be interpreted in an idealized or overly formal sense unless expressly so defined herein.

An electronic device as used herein may be include an antenna capable of performing a communication function in at least one frequency band, and may be a smart phone, a tablet personal computer (PC), a mobile phone, a video phone, an e-book reader, a desktop PC, a laptop PC, a netbook computer, a personal digital assistant (PDA), a portable multimedia player (PMP), a moving picture experts group phase 1 or phase 2 (MPEG-1 or MPEG-2) audio layer 3 (MP3) player, a mobile medical device, a camera, and a wearable device, such as a head-mounted-device (HMD) including electronic glasses, electronic clothes, an electronic bracelet, an electronic necklace, an electronic appcessory, an electronic tattoo, or a smart watch, or the like, for example, and without limitation.

The electronic device may be a smart home appliance having an antenna, such as a television (TV), a digital versatile disc (DVD) player, an audio player, a refrigerator, an air conditioner, a cleaner, an oven, a microwave oven, a washing machine, an air purifier, a set-top box, a TV box, such as Samsung HomeSync®, Apple TV®, or Google TV®, a game console, an electronic dictionary, an electronic key, a camcorder, and an electronic picture frame, or the like, but is not limited thereto.

The electronic device including the antenna may be one of various medical devices, such as magnetic resonance angiography (MRA), magnetic resonance imaging (MRI), computed tomography (CT), imaging equipment, and an ultrasonic instrument, a navigation device, a global positioning system (GPS) receiver, an event data recorder (EDR), a flight data recorder (FDR), a car infotainment device, electronic equipment for a ship, such as a vessel navigation device, and a gyro compass, avionics, a security device, a car head unit, an industrial or domestic robot, an automated teller machine (ATM), and a point of sales (POS) device, or the like, but is not limited thereto.

The electronic device may be part of at least one of an item of furniture or a building/structure including an antenna. The electronic device may be an electronic board, an electronic signature input device, a projector, or any of various measurement machines for such utilities as water supply, electricity, gas, and a propagation measurement machine, or the like, but is not limited thereto.

The electronic device may be one or more combinations of the aforementioned various devices. In addition, the electronic device may be a flexible device. Moreover, the electronic device is not limited to the aforementioned devices.

Hereinafter, an electronic device according to example embodiments of the present disclosure will be described with reference to the accompanying drawings. The term 'user' used in the embodiments may refer to a person who uses the electronic device or a device which uses the electronic device, such as an artificial intelligence (AI) electronic device. In the following description, the term annular member is used for convenience and to aid in understanding. However, it will be understood that the term annular member refers, for example, to an annulus, e.g., a substantially ring-like structure, ring shape structure, a ring structure, or the like.

FIG. 1 is a diagram illustrating an example network environment including an electronic device according to an example embodiment of the present disclosure.

Referring to FIG. 1, a network environment 100 includes an electronic device 101. The electronic device 101 includes a bus 110, a processor 120, a memory 130, an input/output interface (e.g., including input/output circuitry) 150, a display 160, and a communication interface (e.g., including communication circuitry) 170. In embodiments of the present disclosure, the electronic device 101 can omit at least one of the components or further include another component.

The bus 110 includes a circuit for connecting the components and delivering communications such as a control message therebetween.

The processor 120 includes one or more of a central processing unit (CPU), an application processor (AP), and a communication processor (CP). The processor 120 processes an operation or data on control of and/or communication with another component of the electronic device 101.

The processor 120, which is connected to the long term evolution (LTE) network, determines whether a call is connected over the circuit switched (CS) service network using caller identification information, such as a caller phone number of the CS service network, such as the 2nd generation (2G) or 3rd generation (3G) network. For example, the processor 120 receives incoming call information, such as a CS notification message or a paging request message of the CS service network over the LTE network, such as circuit-switched fallback (CSFB). The processor 120 being connected to the LTE network receives incoming call information, such as a paging request message over the CS service network, such as single radio LTE (SRLTE).

When receiving the incoming CS notification message or a paging request message of the CS service network over the LTE network, the processor 120 obtains caller identification information from the incoming call information. The processor 120 displays the caller identification information on the display 160. The processor 120 determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection. For example, when detecting input information corresponding to an incoming call acceptance, through the input/output interface 150, the processor 120 connects the voice call by connecting to the CS service network.

When receiving the incoming CS notification message or a paging request message of the CS service network over the LTE network, the processor 120 obtains caller identification information from the incoming call information. The processor 120 determines whether to connect the call by comparing the caller identification information with a reception control list. For example, when the caller identification information is included in a first reception control list, such as a blacklist, the processor 120 restricts the voice call connection and maintains the connection to the LTE network. When the caller identification information is not included in the blacklist, the processor 120 connects the voice call by connecting to the CS service network. When the caller identification information is included in a second reception control list, such as a white list, the processor 120 connects the voice call by connecting to the CS service network.

When receiving the incoming call information, such as a paging request message of the CS service network over the LTE network, the processor 120 sends an incoming call response message, such as a paging response message, to the CS service network. The processor 120 suspends the LTE service and receives the caller identification information, such as a circuit-switched call (CC) setup message, from the CS service network. The processor 120 determines whether to connect the call by comparing the caller identification information with the reception control list. For example, when the caller identification information is included in the blacklist, the processor 120 restricts the voice call connection and resumes the LTE network connection. When the caller identification information is not included in the he blacklist, the processor 120 connects the voice call by connecting to the CS service network. For example, when the caller identification information is included in the white list, the processor 120 connects the voice call by connecting to the CS service network.

The memory 130 can include volatile and/or nonvolatile memory. The memory 130 stores commands or data, such as the reception control list relating to at least another component of the electronic device 101. The memory 130 may store software and/or a program 140. The program 140 may include a kernel 141, middleware 143, an application programming interface (API) 145, and/or application programs (or "applications) 147. At least some of the kernel 141, the middleware 143, and the API 145 may be referred to as an operating system (OS).

The kernel 141 controls or manages system resources, such as the bus 110, the processor 120, or the memory 130 used for performing an operation or function implemented by the other programs, such as the middleware 143, the API 145, or the applications 147. Furthermore, the kernel 141 provides an interface through which the middleware 143, the API 145, or the applications 147 connects the individual elements of the electronic device 101 to control or manage the system resources.

The middleware 143 functions as an intermediary for allowing the API 145 or the applications 147 to communicate with the kernel 141 to exchange data.

In addition, the middleware 143 processes one or more task requests received from the applications 147 according to priorities thereof. For example, the middleware 143 assigns priorities for using the system resources of the electronic device 101, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function, such as an instruction for file control, window control, image processing, or text control.

The input/output interface 150 may include various circuitry that are configured and arranged to function as an interface that transfers instructions or data input from a user or another external device to the other element(s) of the electronic device 101. Furthermore, the input/output interface 150 outputs the instructions or data received from the other element(s) of the electronic device 101 to the user or an external electronic device.

The display 160 may include a liquid crystal display (LCD), a light emitting diode (LED) display, an organic LED (OLED) display, a micro electro mechanical system (MEMS) display, an electronic paper display, etc. The display 160 displays various types of content, such as text, images, videos, icons, or symbols for the user. The display 160 may include a touch screen and receive, for example, a touch, a gesture, proximity, a hovering input, etc., using an electronic pen or the user's body part. The display 160 may display a web page.

The communication interface 170 may including various communication circuitry that can establish a communication between the electronic device 101 and an external electronic device, such as a first external electronic device 102, a second external electronic device 104, or a server 106. For example, the communication interface 170 includes various communication circuitry that can communicate with the first external electronic device 102, the second external electronic device 104, or the server 106 in connection to the network 162 through wireless communication or wired communication or via a short-range communication 164. For example, the wireless communication can conform to a cellular communication protocol including at least one of LTE, LTE-advanced (LTE-A), code division multiple access (CDMA), wideband CDMA (WCDMA), universal mobile telecommunication system (UMTS), wireless broadband (WiBro), and global system for mobile communications (GSM).

The wired communication can include at least one of universal serial bus (USB), high definition multimedia interface (HDMI), recommended standard 232 (RS-232), and plain old telephone service (POTS).

The network 162 can include at least one of telecommunications networks, for example, a computer network such as local area network (LAN) or wide area network (WAN), the Internet, and a telephone network.

The electronic device 101 provides the LTE service in the single radio environment by use of at least one module functionally or physically separated from the processor 120.

Each of the first and second external electronic devices 102 and 104 may be a type of device that is the same as or different from the electronic device 101. According to an embodiment of the present disclosure, the server 106 may include a group of one or more servers. All or some of the operations to be executed by the electronic device 101 may be executed by another electronic device or a plurality of other electronic devices, such as the electronic devices 102 and 104 or the server 106. In the case where the electronic device 101 may perform a certain function or service automatically or by request, the electronic device 101 may request some functions that are associated therewith from the other electronic devices instead of or in addition to executing the function or service by itself. The electronic devices 102 and 104 or the server 106 may execute the requested functions or additional functions, and may transmit the results to the electronic device 101. The electronic device 101 may provide the requested functions or services by processing the received results. For this purpose, for example, a cloud computing technique, a distributed computing technique, or a client-server computing technique may be used.

Figure 2:
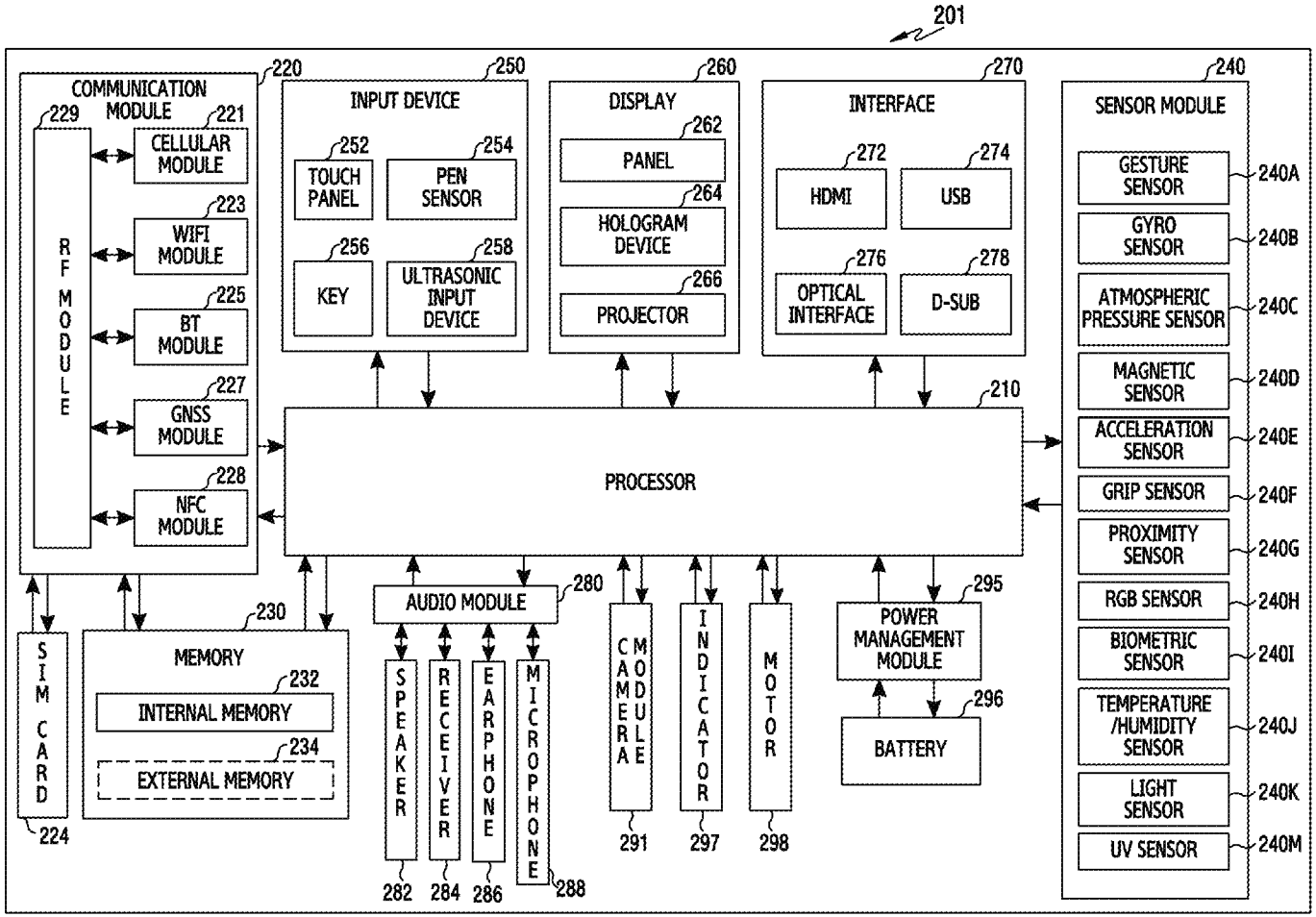
FIG. 2 is a block diagram illustrating an example electronic device according to various example embodiments of the present disclosure.

FIG. 2 is a diagram illustrating an example configuration of an electronic device according to an example embodiment of the present disclosure.

Referring to FIG. 2, the electronic device 201 may include all or some of the components described with reference to the electronic device 101 of FIG. 1. The electronic device 201 includes at least one processor (AP) 210, a communication module (e.g., including communication circuitry) 220, a subscriber identification module (SIM) card 224, a memory 230, a sensor module 240, an input device (e.g., including input circuitry) 250, a display 260, an interface (e.g., including interface circuitry) 270, an audio module 280, a camera module 291, a power management module 295, a battery 296, an indicator 297, and a motor 298.

The AP 210 controls a plurality of hardware or software elements connected to the AP 210 by driving an OS or an application program. The AP 210 processes a variety of data, including multimedia data, performs arithmetic operations, may be implemented with a system on chip (SoC) and may further include a graphical processing unit (GPU).

The communication module 220 may include various communication circuitry that performs data transmission/reception in communication between the external electronic device 104 or the server 106 which may be connected with the electronic device 201 through the network 162. The communication module 220 includes various communication circuitry, such as, for example, and without limitation, at least one of a cellular module 221, a Wi-Fi module 223, a Bluetooth® (BT) module 225, a global navigation satellite system (GNSS) or GPS module 227, a near field communication (NFC) module 228, and a radio frequency (RF) module 229.

The cellular module 221 provides a voice call, a video call, a text service, or an Internet service, such as through a communication network including LTE, LTE-A, CDMA, WCDMA, UMTS, WiBro, and GSM, for example. In addition, the cellular module 221 identifies and authenticates the electronic device 201 within the communication network by using the SIM card 224. The cellular module 221 may perform at least some of functions that can be provided by the AP 210. For example, the cellular module 221 may perform at least some of multimedia control functions.

The cellular module 221 includes a CP. Further, the cellular module 221 may be implemented, for example, with an SoC. Although elements, such as the cellular module 221, the memory 230, and the power management module 295 are illustrated as separate elements with respect to the AP 210 in FIG. 2, the AP 210 may also be implemented such that at least one part, such as the cellular module 221 of the aforementioned elements is included in the AP 210.

The AP 210 or the cellular module 221 loads an instruction or data, which is received from each non-volatile memory connected thereto or at least one of different elements, to a volatile memory and processes the instruction or data. In addition, the AP 210 or the cellular module 221 stores data, which is received from at least one of different elements or generated by at least one of different elements, into the non-volatile memory.

Each of the Wi-Fi module 223, the BT module 225, the GNSS module 227, and the NFC module 228 includes a processor for processing data transmitted/received through a corresponding module. Although the cellular module 221, the Wi-Fi module 223, the BT module 225, the GNSS module 227, and the NFC module 228 are illustrated in FIG. 2 as separate blocks, at least two of the cellular module 221, the Wi-Fi module 223, the BT module 225, the GNSS module 227, and the NFC module 228 may be included in one integrated chip (IC) or IC package. For example, at least some of processors corresponding to the cellular module 221, the Wi-Fi module 223, the BT module 225, the GNSS module 227, and the NFC module 228, such as a communication processor corresponding to the cellular module 221 and a Wi-Fi processor corresponding to the Wi-Fi module 223, may be implemented with an SoC.

The RF module 229 transmits/receives data, such as an RF signal, and may include a transceiver, a power amp module (PAM), a frequency filter, or a low noise amplifier (LNA), for example. In addition, the RF module 229 may further include a component for transmitting/receiving a radio wave on a free space in wireless communication, for example, a conductor, or a conducting wire. The cellular module 221, the Wi-Fi module 223, the BT module 225, the GNSS module 227, and the NFC module 228 may share one RF module 229, and at least one of these modules may transmit/receive an RF signal via a separate RF module.

The SIM card 224 may be inserted into a slot formed at a specific location of the electronic device 201. The SIM card 224 includes unique identification information, such as an integrated circuit card identifier (ICCID) or subscriber information, such as an international mobile subscriber identity (IMSI).

The memory 230 includes an internal memory 232 or an external memory 234.

The internal memory 232 may include at least one of a volatile memory, such as a dynamic random access memory (DRAM), a static RANI (SRAM), or a synchronous dynamic RAM (SDRAM) or a non-volatile memory, such as a one-time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, and a not or (NOR) flash memory. The internal memory 232 may be a solid state drive (SSD).

The external memory 234 may include a flash drive, a compact flash (CF), secure digital (SD), micro-SD, mini-SD, extreme digital (xD), and a memory stick, and may be operatively coupled to the electronic device 201 via various interfaces.

The electronic device 201 may further include a storage unit (or a storage medium), such as a hard drive.

The sensor module 240 measures a physical quantity or detects an operation state of the electronic device 201, and converts the measured or detected information into an electrical signal. The sensor module 240 includes, for example, at least one of a gesture sensor 240A, a gyro sensor 240B, a barometric pressure sensor, atmospheric sensor or air sensor 240C, a magnetic sensor 240D, an acceleration sensor 240E, a grip sensor 240F, a proximity sensor 240G, a color sensor 240H, such as a red, green, blue (RGB) sensor, a biometric sensor 240I, a temperature/humidity sensor 240J, an illumination/illuminance (e.g., light) sensor 240K and an ultraviolet (UV) sensor 240M.

Additionally or alternatively, the sensor module 240 may include, for example, an E-node sensor, an electromyography (EMG) sensor, an electroencephalogram (EEG) sensor, an electrocardiogram (ECG) sensor, and a fingerprint sensor.

The sensor module 240 may further include a control circuit for controlling at least one or more sensors included therein.

The input device 250 may include various input circuitry, such as, for example, and without limitation, a touch panel 252, a (digital) pen sensor 254, a key 256, or an ultrasonic input unit 258.

The touch panel 252 recognizes a touch input by using at least one of an electrostatic type configuration, a pressure-sensitive type configuration, and an ultrasonic type configuration. The touch panel 252 may further include a control circuit. In the instance where the touch panel is of the electrostatic type, both physical contact recognition and proximity recognition are possible. The touch penal 252 may further include a tactile layer, which provides the user with a tactile reaction.

The (digital) pen sensor 254 may include a recognition sheet which is a part of the touch panel or is separated from the touch panel. The key 256 may include a physical button, an optical key, or a keypad. The ultrasonic input device 258 may detect ultrasonic waves generated by an input tool through a microphone 288, and may confirm data corresponding to the detected ultrasonic waves.

The (digital) pen sensor 254 may be implemented by using the same or similar method of receiving a touch input of the user or by using an additional sheet for recognition.

The key 256 may be a physical button, an optical key, a keypad, or a touch key.

The ultrasonic input unit 258 is a device by which the electronic device 201 detects a reflected sound wave through the microphone 288 and is capable of radio recognition. For example, an ultrasonic signal, which may be generated by using a pen, may be reflected off an object and detected by the microphone 288.

The electronic device 201 may use the communication module 220 to receive a user input from an external device, such as a computer or a server connected thereto.

The display 260 includes a panel 262, a hologram 264, or a projector 266.

The panel 262 may be a liquid crystal display (LCD) or an active-matrix organic light-emitting diode (AM-OLED), or the like, but is not limited thereto. The panel 262 may be implemented in a flexible, transparent, or wearable manner, and may be constructed as one module with the touch panel 252.

The hologram device 264 uses an interference of light and displays a stereoscopic image in the air.

The projector 266 displays an image by projecting a light beam onto a screen. The screen may be located inside or outside the electronic device 201.

The display 260 may further include a control circuit for controlling the panel 262, the hologram device 264, or the projector 266.

The interface 270 may include various interface circuitry, such as, for example, and without limitation, a high definition multimedia interface (HDMI) 272, a universal serial bus (USB) 274, an optical communication interface 276, or a D-subminiature (D-sub) 278. The interface 270 may be included, for example, in the communication interface 160 of FIG. 1, and may include a mobile high-definition link (MHL), SD/multi-media card (MMC) or infrared data association (IrDA).

The audio module 280 bilaterally converts a sound and an electric signal. At least some elements of the audio module 280 may be included in the input/output interface 150 of FIG. 1. The audio module 280 converts sound information which is input or output through a speaker 282, a receiver 284, an earphone 286, or the microphone 288 for example.

The speaker 282 may output a signal of an audible frequency band and a signal of an ultrasonic frequency band. Reflected waves of an ultrasonic signal emitted from the speaker 282 and a signal of an external audible frequency band may be received.

The camera module 291 is a device for image and video capturing, and may include one or more image sensors, such as a front sensor or a rear sensor, a lens, an image signal processor (ISP), or a flash, such as a light emitting diode (LED) or a xenon lamp. In certain instances, it may prove advantageous to include two or more camera modules.

The power management module 295 manages power of the electronic device 201. The power management module 295 may include a power management integrated circuit (PMIC), a charger IC, or a battery gauge.

The PMIC may be placed inside an IC or SoC semiconductor. Charging is classified into wired charging and wireless charging. The charger IC charges a battery, prevents an over-voltage or over-current flow from a charger, and includes a charger IC for at least one of the wired and the wireless charging.

The wireless charging may be classified, for example, into a magnetic resonance type, a magnetic induction type, and an electromagnetic type. An additional circuit for the wireless charging, such as a coil loop, a resonant circuit, or a rectifier may be added.

The battery gauge may measure a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a specific state, such as a booting, a message, or a charging state of the electronic device 201 or a part thereof, such as the AP 210.

The motor 298 converts an electric signal into a mechanical vibration.

The electronic device 201 includes a processing unit, such as a GPU, for supporting mobile TV which processes media data according to a protocol of, for example, digital multimedia broadcasting (DMB), digital video broadcasting (DVB), or media flow.

Each of the aforementioned elements of the electronic device 201 may include one or more components, and names thereof may vary depending on a type of the electronic device 201. The electronic device 201 may include at least one of the aforementioned elements. Some of the elements may be omitted, or additional other elements may be further included. In addition, some of the elements of the electronic device 201 may be combined and constructed as one entity, so as to equally perform functions of corresponding elements before combination.

At least some parts of a device, such as modules or functions thereof, or operations, may be implemented with an instruction stored in a computer-readable storage media for example. The instruction may be executed by the processor 210, to perform a function corresponding to the instruction. The computer-readable storage media may be the memory 230. At least some parts of the programming module may be executed by the processor 210. At least some parts of the programming module may include modules, programs, routines, and a set of instructions for performing one or more functions.

The electronic device according to various example embodiments of the present disclosure may relate to a wearable electronic device which can be worn on a user's body, and has been illustrated and described regarding this. However, this should not be considered as limiting, and the electronic device may be applied to various electronic devices including an annular member (for example, a rotary wheel) according to example embodiments of the present disclosure. For example, the electronic device may include a normal bar type electronic device, a slide type electronic device, a foldable type electronic device, or the like.

Figure 3:
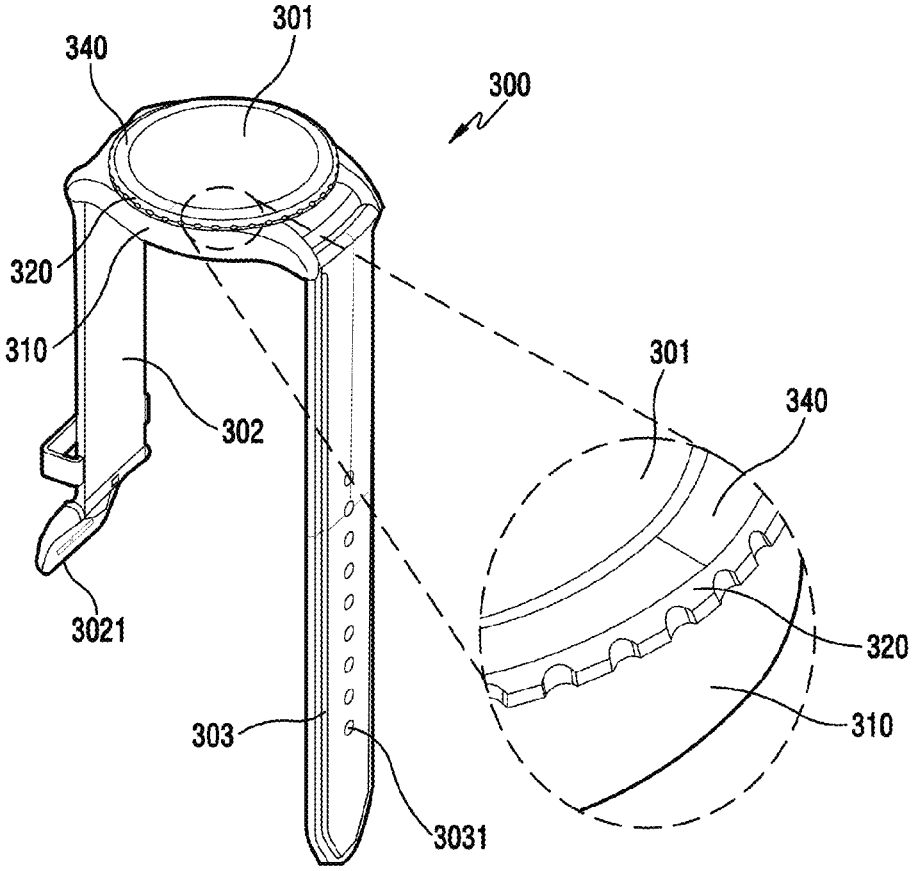
FIG. 3 is a perspective view illustrating an example electronic device according to various example embodiments of the present disclosure.

FIG. 3 is a perspective view illustrating an example electronic device 300 according to various example embodiments of the present disclosure.

Referring to FIG. 3, the electronic device 300 may, for example, be a wrist wearable electronic device which can be worn on a user's wrist. According to an example embodiment, the electronic device 300 may include a housing 310 which is used as a main body, and at least one connection member or wearing structure 302, 303 (for example, and without limitation, a strap) which is mounted on at least a part of the housing 310 and configured to enable the electronic device to be worn by a user. It will be understood that various arrangements for enable wearing of the electronic device may be used and may include various connection elements, such as, for example, and without limitation, a strap, a band, a sticker, a necklace, or the like. According to an example embodiment, the electronic device 300 may be worn in such a way that the housing 310 is placed on the user's wrist and then the connection member 302, 303 is wound around the user's wrist. According to an example embodiment, a buckle member 3021 may be disposed on one connection member 302, and a plurality of adjustment openings 3031 may be formed on the other connection member 303, for fastening with the buckle member 3021. According to an example embodiment, the buckle member 3021 is fastened to one of the plurality of adjustment openings 3031, such that the electronic device can have its wearing position adjusted to fit the user's wrist. According to an example embodiment, the connection member 302, 303 may be formed of at least one of metal, leather, rubber, silicon, and urethane.

According to various example embodiments, the housing 310 may include a display 301. The display 301 may include a touch sensor and may be used as a screen device. According to an example embodiment, at least one key button (not shown) may be disposed at an appropriate location of the housing 310. According to an example embodiment, the electronic device 300 may apply a battery (for example, a rechargeable battery or the like) as a means for supplying power to the inside, and may include a wireless charging coil member for charging the battery. According to an example embodiment, the electronic device may be implemented to be selectively mounted in a predetermined portable charging cradle to charge the battery.

According to various example embodiments, the electronic device 300 may include an annular member 320 (for example, a wheel, a rotary body, or the like) rotatably disposed on the housing 310. According to an example embodiment, the annular member 320 may be installed to surround the entirety of the display 301 disposed on the housing 310. According to an example embodiment, when the electronic device 300 is a wrist wearable electronic device, the annular member 320 may be disposed in the form of a rotatable bezel. According to an example embodiment, the annular member 320 may be rotated in a clockwise direction or a counter clockwise direction, and may be regulated to be rotated by up to 360 degrees or may be configured to be rotated limitlessly. According to an example embodiment, the annular member 320 may include a decoration member 340 disposed on the top surface thereof along a border. According to an example embodiment, the decoration member 340 may be formed to have its top surface coated with a paint or imprinted, and thus may further include an indicator element for making a rotation parameter of the annular member 320 recognized by the user.

The electronic device may include at least one sensor device disposed in at least a part of the housing 310 although it is not shown. According to an example embodiment, the sensor device may include various sensors such as, for example, and without limitation, a camera sensor, a fingerprint recognition sensor, an infrared ray sensor, a Heart Rate Monitor (HRM) sensor, a photo sensor, a proximity sensor, an illuminance sensor, a temperature sensor, or the like.

According to various example embodiments, a spacer 415 (see FIG. 4) may be disposed between the rotatable annular member 320 and the housing 310, as will be described in greater detail below. According to an example embodiment, the spacer 415 may prevent and/or reduce friction from being generated by contact between the annular member 320 and the housing 310, such that a problem that the annular member 320 is not smoothly rotated due to abrasion caused by long usage can be prevented and/or reduced in advance.

Figure 4:
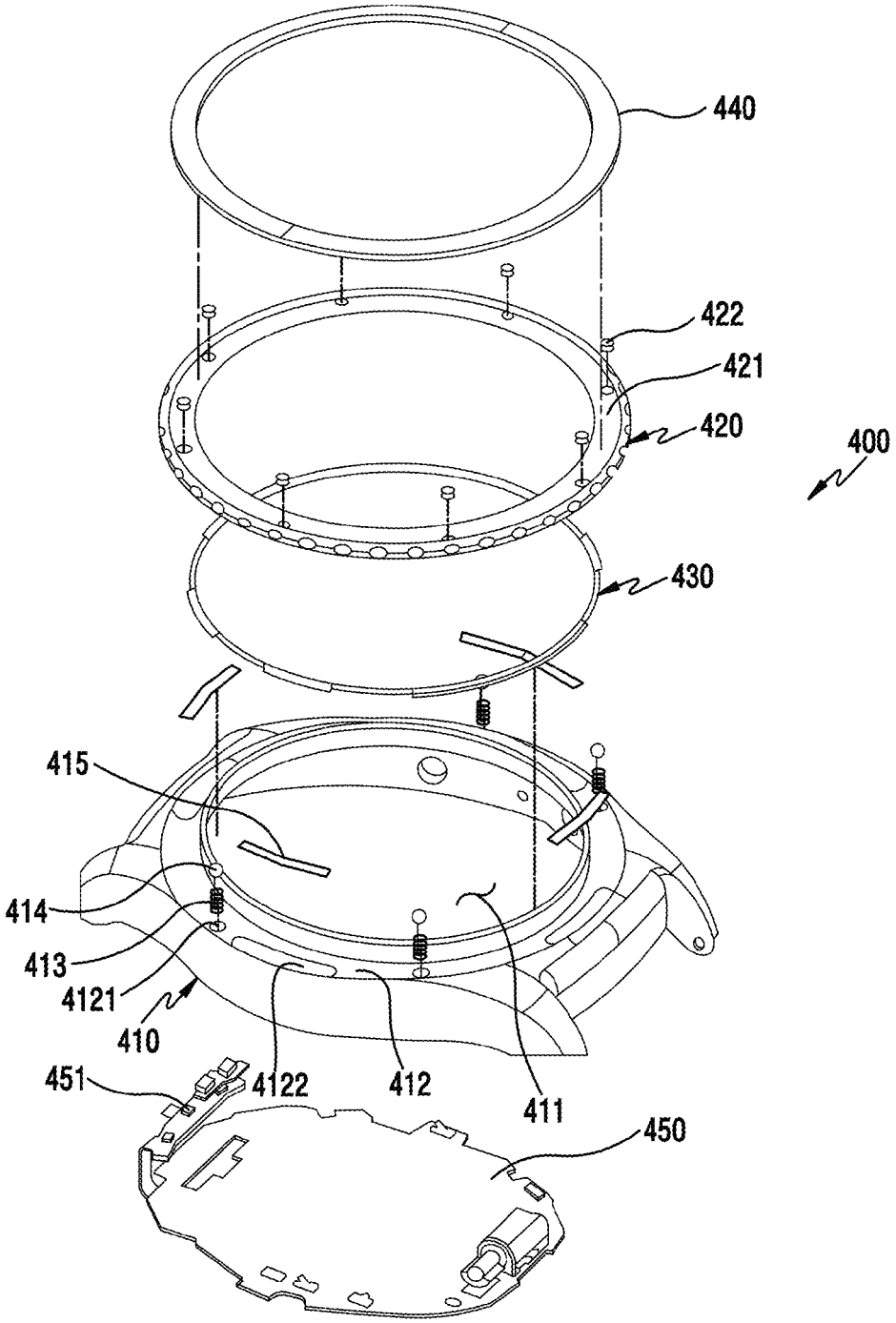
FIG. 4 is an exploded perspective view illustrating an example electronic device according to various example embodiments of the present disclosure.

FIG. 4 is an exploded perspective view illustrating an example electronic device 400 according to various example embodiments of the present disclosure.

The electronic device 400 of FIG. 4 is similar to the electronic device 300 of FIG. 3 or may be another example embodiment of the electronic device. In explaining the drawing, a connection member similar to that of FIG. 3 may be applied to the electronic device 400 of FIG. 4, but a description thereof is omitted for convenience of explanation.

Referring to FIG. 4, the electronic device 400 may include a housing 410 including a substantially circular opening 411, and an annular member 420 and a decoration member 440 which are stacked in sequence along the border of the opening 411 of the housing 410. According to an example embodiment, an interface 430 may be disposed between the annular member 420 and the housing 410. According to an example embodiment, the interface 430 may be fixed to the housing 410 and may serve to guide the annular member 420 to be rotatable. According to an example embodiment, a substrate 450 (for example, a printed circuit board (PCB), a flexible PCB (FPCB), or the like) may be disposed in the inner space of the housing 410, and a sensor module 451 may be disposed on a substrate 450 to detect a plurality of magnetic elements 422 arranged on the annular member 420. According to an example embodiment, the sensor module 451 may include a hall sensor mounted on the substrate 450.

According to various example embodiments, a circular first surface 412 may be formed along the border of the opening 411 of the housing 410. According to an example embodiment, a hole 4121 may be disposed on the first surface 412 to receive at least one elastic structure. According to an example embodiment, the elastic structure may be arranged at four locations at regular intervals along the first surface 412, but this should not be considered as limiting. According to an example embodiment, the elastic structure may include, for example, a spring member 413 which is inserted into the hole 4121, and a ball 414 which is inserted into at least a part of the hole 4121 from the upper portion of the spring member 413 and is pressed toward the outside by the spring member 413. According to an example embodiment, the ball 414 may be formed of metal or ceramic, and the ball 414 pressed by the spring member 413 may press a second surface 423 (see FIG. 5B) (for example, a bottom surface) of the annular member 420 disposed on the top of the housing 410 toward the outside.

According to various example embodiments, at least one spacer 415 may be disposed on the first surface 412 of the housing 410, avoiding the elastic structure. According to an example embodiment, the spacer 415 may prevent the annular member 420 and the first surface 412 of the housing 410 from being brought into contact with each other and thereby may remove friction between the annular member 420 and the housing 410. According to an example embodiment, the spacer 415 may be formed of Teflon, synthetic resin, or the like, and may perform a lubrication action. According to an example embodiment, when the annular member 420 is rotated, the spacer 415 may serve to remove a foreign substance (for example, particles or the like generated by friction between the ball and the annular member of metal) which is attached to the second surface 423 of the annular member 420. According to an example embodiment, the spacer 415 may be arranged at four locations at regular intervals along the first surface 412 of the housing 410, but this should not be considered as limiting.

According to various example embodiments, the annular member 420 may be formed to substantially correspond to the first surface 412 of the housing 410. According to an example embodiment, the annular member 420 may include a first surface 421 facing a direction opposite to the housing 410, and the second surface 423 (see FIG. 5B) facing the housing 410. According to an example embodiment, a plurality of magnetic elements 422 may be installed on the first surface 421 of the annular member 420 at regular intervals. According to an example embodiment, the sensor module 451 may be disposed at a location perpendicularly overlapping the rotation trajectory of the magnetic elements 422, for detecting the magnetic force of the magnetic elements 422 when the annular member 420 is rotated. According to an example embodiment, the magnetic elements 422 may be inserted into and fixed to the first surface 421 to be flush with the first surface 421 of the annular member 420, and the decoration member 440 may be disposed on the upper portions of the magnetic elements 422. According to an example embodiment, the magnetic elements 422 may be disposed at eight locations at regular intervals along the first surface 421 of the annular member 420, but this should not be considered as limiting.

According to an example embodiment, the interface 430 may be formed in an annular shape, and may be fixed to the first surface 412 of the housing 410 and guide the annular member 420 to be rotatable. According to an example embodiment, when the interface 430 is fixed to the housing 410 and guides the annular member 420, the interface 430 may also act as a lubrication member for reducing friction.

Figure 5A:
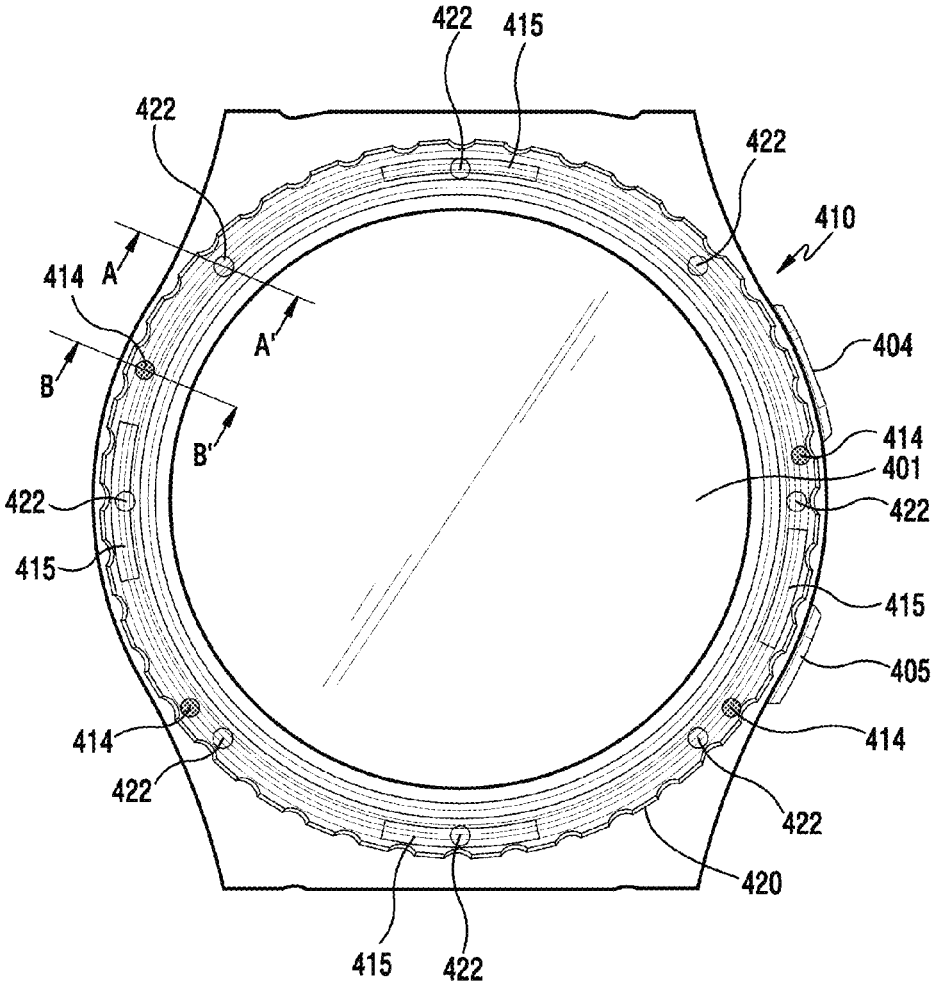
FIG. 5A is a diagram illustrating an example arrangement relationship of a magnetic element, a ball, and a spacer in the electronic device according to various example embodiments of the present disclosure.

FIG. 5A is a view illustrating an example arrangement relationship of the magnetic element, the ball, and the spacer in the electronic device according to various example embodiments of the present disclosure.

Referring to FIG. 5A, the rotatable annular member 420 may be disposed on the housing 410 to surround along the border of the display 401. According to an example embodiment, the annular member 420 may include the magnetic elements 422 which are applied as detection members for detecting the rotation parameter of the annular member 420. According to an example embodiment, the ball 414 for providing the click sense to the user according to the rotation of the annular member 420 and the spacer 415 for reducing friction between the annular member 420 and the housing 410 according to the rotation of the annular member 420 may be disposed on an area where the annular member 420 and the housing 410 overlap each other. According to an example embodiment, the ball 414 and the spacer 415 disposed on the housing 410 may be disposed at locations where the ball 414 and the spacer 415 do not overlap each other.

According to various example embodiments, the electronic device 400 may include at least one sensor module (for example, 451 of FIG. 4) disposed at a location corresponding to the rotation trajectory of the magnetic elements 422 which move according to the rotation of the annular member 420, and may detect the rotation parameter of the annular member 420. According to an example embodiment, the sensor module 451 may include a hall sensor. According to an example embodiment, when the electronic device is implemented in a watch type, the sensor module 451 may be disposed at 12 o'clock or 6 o'clock in the housing 410.

Figure 5B:
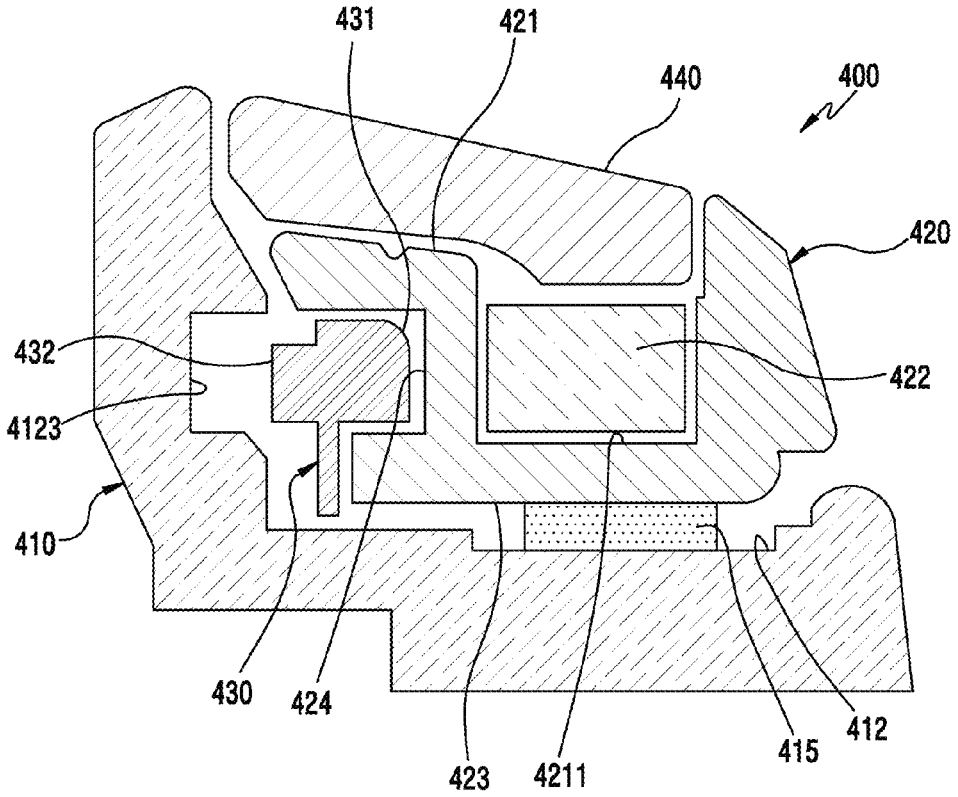
FIG. 5B is a main part cross section view of the electronic device, illustrating the example magnetic element and the spacer installed therein according to various example embodiments of the present disclosure.

FIG. 5B is a diagram illustrating an example main part cross section view of the electronic device, illustrating the magnetic element and the spacer installed therein according to various example embodiments of the present disclosure. According to an example embodiment, FIG. 5B is a main part cross section view taken along line A-A' of FIG. 5A.

Referring to FIG. 5B, the magnetic elements 422 may be seated in a plurality of mounting recesses 4211 formed on the first surface 421 of the annular member 420. According to an example embodiment, the first surface 421 of the annular member 420 in which the magnetic element 422 is disposed may be finished by the decoration member 440. According to an example embodiment, the decoration member 440 may be formed of synthetic resin which is plated with chrome or formed of metal (for example, steel use stainless (SUS) or the like). According to an example embodiment, the decoration member 440 may be fixed to the first surface 421 of the annular member 420, and may be formed to have its top surface coated with a paint or imprinted, and thus may further include an indicator element for making the rotation parameter of the annular member 420 recognized by the user.

According to various example embodiments, the spacer 415 may be disposed on the first surface 412 of the housing 410. According to an example embodiment, the spacer 415 may be attached to the first surface 412 of the housing 410. According to an example embodiment, the spacer 415 may be provided in the form of a tape which is made of Teflon having high abrasion resistance and has a predetermined thickness. However, this should not be considered as limiting. The spacer 415 may be implemented by attaching or assembling Teflon such as POM or an injection molding material of a nylon group having a lubrication function, in addition the tape.

According to various example embodiments, the annular member 420 may be rotatably installed on the housing 410 due to the interface 430. According to an example embodiment, the annular member 420 may include a guide recess 424 formed on one side thereof, and a guide rib 431 protruding from one side of the interface 430 may be seated in the guide recess 424, such that the annular member 420 can be rotatably installed on the housing 410. According to an example embodiment, the interface 430 may include a locking projection 432 protruding from the other side thereof toward the center of the housing 410, and the interface 430 may be fixed to the housing 410 in such a way that the locking projection 432 is locked into a locking recess 4123 formed along the border of the opening of the housing 410. Accordingly, the interface 430 may be fixed to the housing 410 and may have the annular member 420 installed on the housing 410 to be rotatable without deviating from the housing 410.

According to various example embodiments, when the annular member 420 is rotatably installed on the housing 410 due to the interface 430, only the spacer 415 disposed on the first surface 412 of the housing 410 may be brought into contact with the second surface 423 of the annular member 420. According to an example embodiment, the friction of the annular member 420 with the housing 410 may be reduced due to the lubrication action of the spacer 415 and thus the annular member 420 may be smoothly rotated.

Figure 5C:
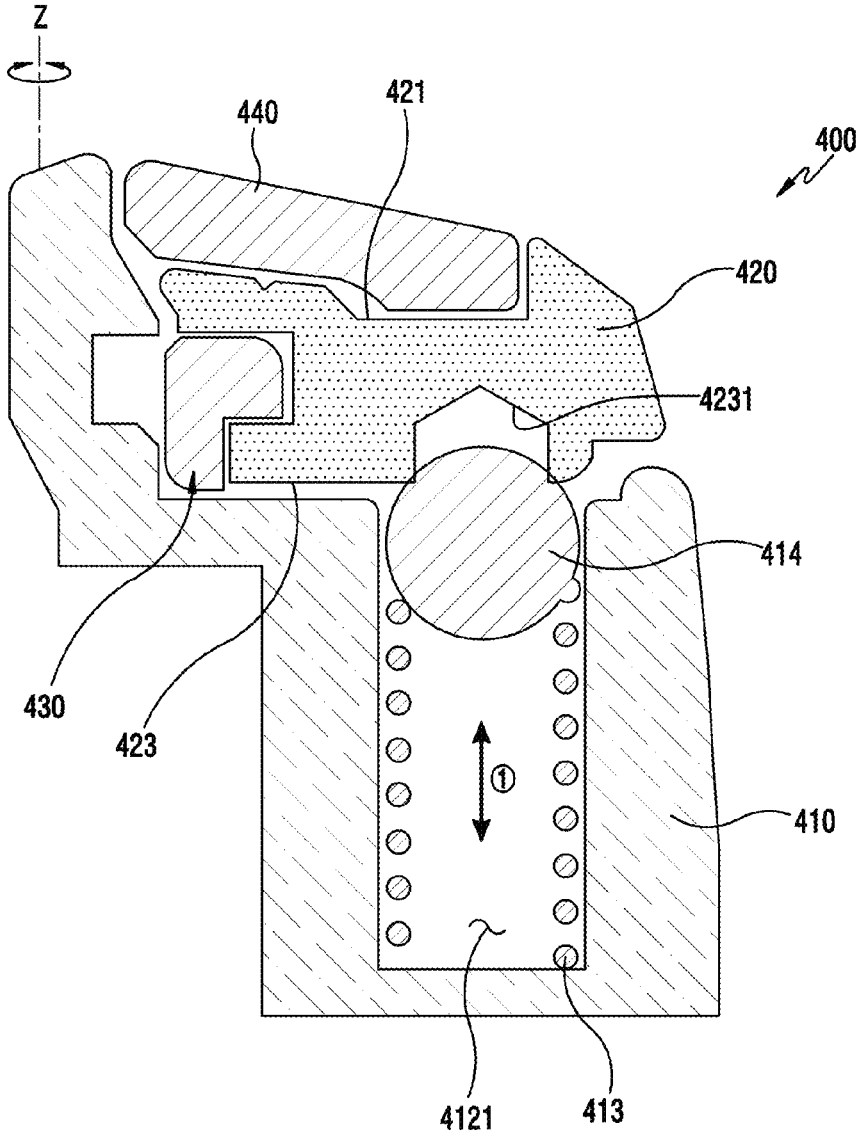
FIGS. 5C and 5D are main part cross section views of the electronic device, illustrating example placement of the ball according to the rotation of the annular member according to various example embodiments of the present disclosure.
Figure 5D:
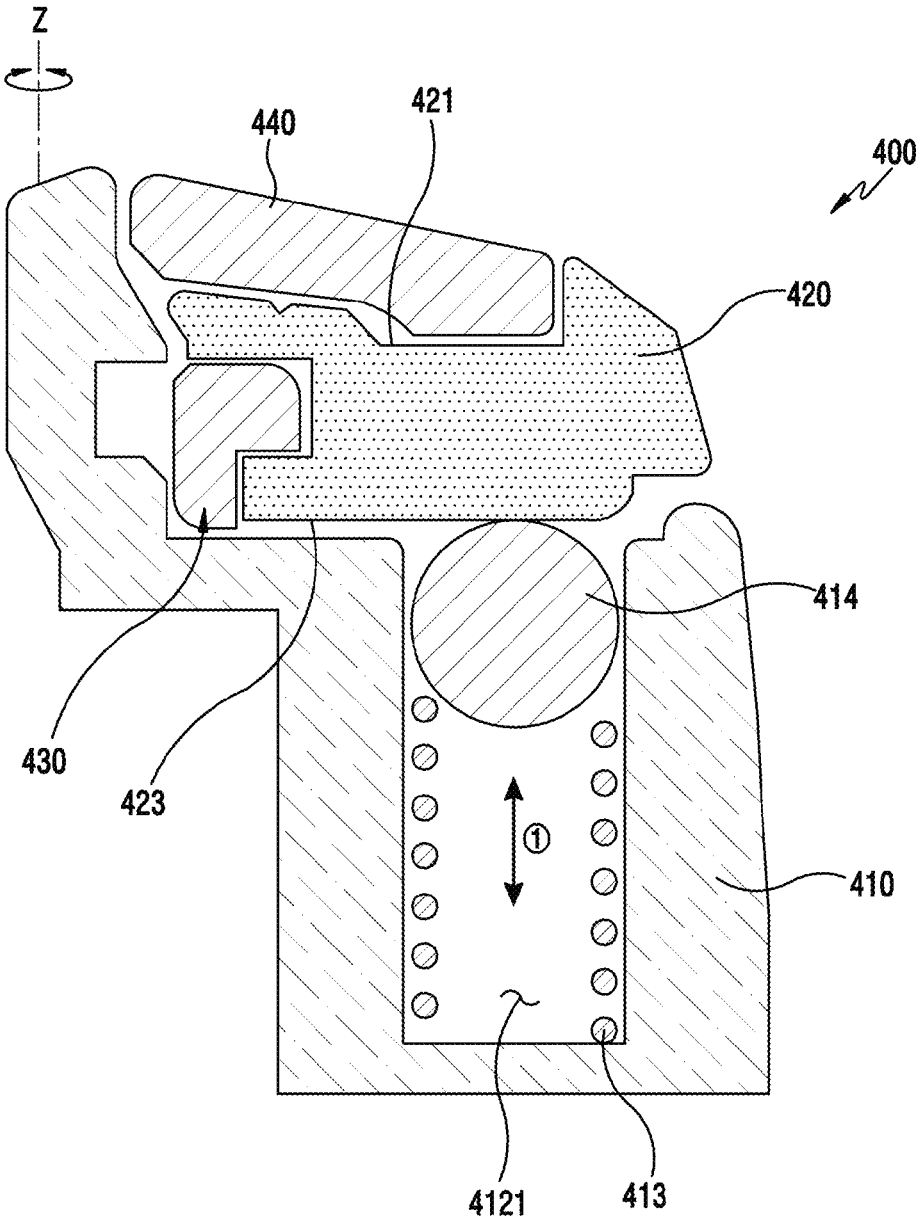

FIGS. 5C and 5D are main part cross section views of the electronic device illustrating example placement of the ball according to the rotation of the annular member according to various example embodiments of the present disclosure. According to an example embodiment, FIGS. 5C and 5D illustrate main part cross section views taken along line B-B' of FIG. 5A.

Referring to FIG. 5C, the housing 410 may include the plurality of holes 4121 which are arranged on the first surface of the housing 410 at regular intervals, and have a predetermined depth. According to an example embodiment, the spring member 413 may be inserted into each of the plurality of holes 4121 and the ball 414 may be inserted into the upper portion of each of the holes 4121. According to an example embodiment, the ball 414 may be disposed to have at least a part thereof protrude upwardly from the hole 4121.

According to various example embodiments, when the annular member 420 is rotatably installed on the housing 410 due to the interface 430, a part of the ball 414 may be selectively seated in each of a plurality of stop holes 4231, which are arranged on the second surface 423 of the annular member 420 at regular intervals, according to the rotation of the annular member 420. According to an example embodiment, the ball 414 may provide the click sense (for example, a rotation sense) to the user every time the part of the ball 414 is seated in the stop hole 4231 according to the rotation of the annular member 420.

According to various example embodiments, the annular member 420 may be rotated about the z axis, and accordingly, the ball 414 may be selectively seated on the second surface 423 of the annular member 420 and in the stop hole 4231 formed on the second surface 423, such that the ball 414 receives a pressure of the spring member 412 and reciprocates in a direction of ①. As illustrated in FIG. 5D, due to the reciprocating motion of the ball 414, the ball 414 is inserted into the stop hole 4231 of the annular member 420 and then leaves the stop hole 4231 and is brought into contact with the second surface 423 again, and, as the annular member 420 is continuously rotated, the ball 414 repeats the operation of being inserted into the neighbor stop hole 4231 and thereby provides the clock sense to the user.

Figure 6A:
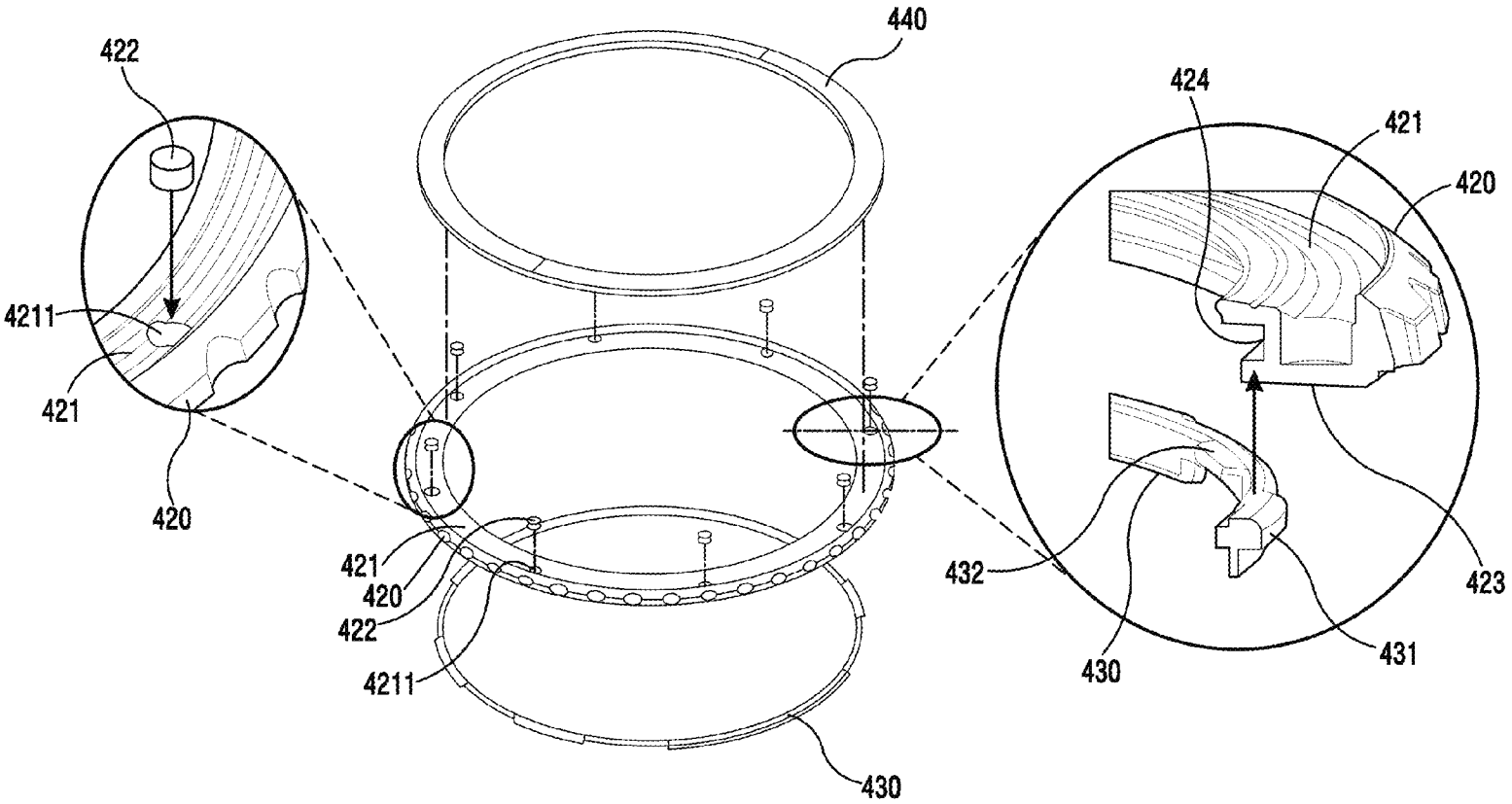
FIGS. 6A and 6B are diagrams illustrating the example magnetic element and an interface which are installed in the annular member according to various example embodiments of the present disclosure.
Figure 6B:
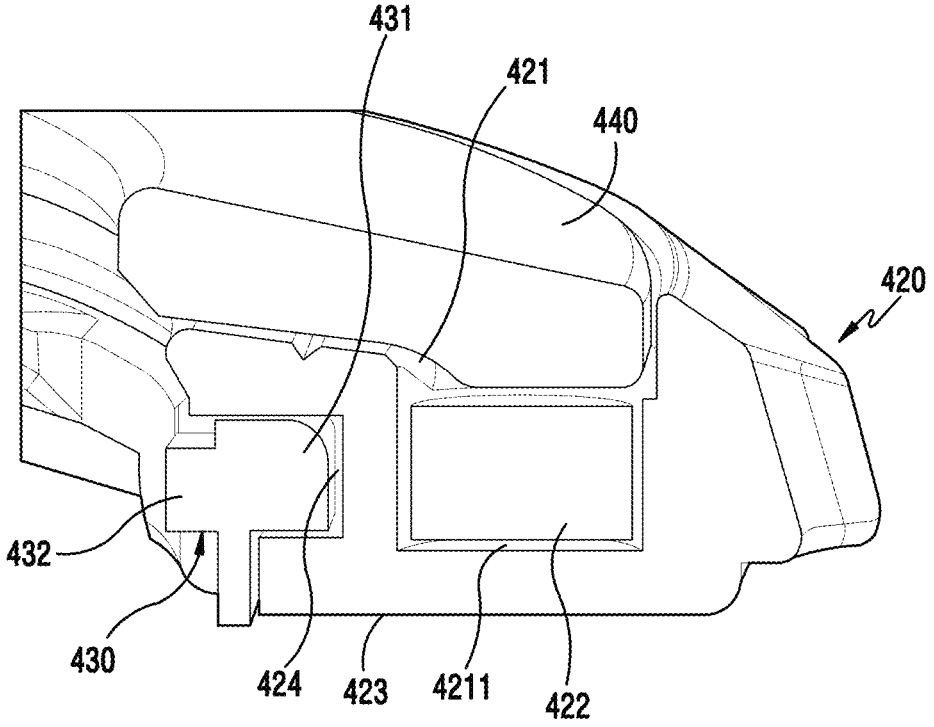

FIGS. 6A and 6B are views illustrating the magnetic elements and the interface which are installed on the annular member according to various example embodiments of the present disclosure.

Referring to FIGS. 6A and 6B, the magnetic elements 422 may be seated in the plurality of mounting recesses 4211 formed on the first surface 421 of the annular member 420. According to an example embodiment, the first surface 421 of the annular member 420 on which the magnetic elements 422 are arranged may be finished by the decoration member 440. According to an example embodiment, the decoration member 440 may be formed of synthetic resin which is plated with chrome, metal (for example, SUS or the like), or ceramic. According to an example embodiment, the decoration member 440 may be fixed to the first surface 421 of the annular member 420, and may be formed to have its top surface coated with a paint or imprinted, and thus may be used as an indicator element for having the rotation parameter of the annular member 420 recognized by the user.

According to various example embodiments, the annular member 420 may be rotatably installed on the housing due to the interface 430. According to an example embodiment, the annular member 420 may include the guide recess 424 formed on one side thereof, and the guide rib 431 protruding from one side of the interface 430 may be seated in the guide recess 424, such that the annular member 420 can be rotatably installed on the housing 410. According to an example embodiment, the interface 430 may include the locking projection 432 protruding from the other side thereof toward the center of the housing 410, and the interface 430 may be fixed to the housing 410 in such a way that the locking projection 432 is locked into the locking recess formed along the border of the housing 410. Accordingly, the interface 430 may be fixed to the housing 410 and may have the annular member 420 installed on the housing 410 to be rotatable without deviating from the housing 410. According to various example embodiments, the annular member 420 may be guided by the interface serving as a lubrication member and thus can be smoothly rotated.

Figure 7:
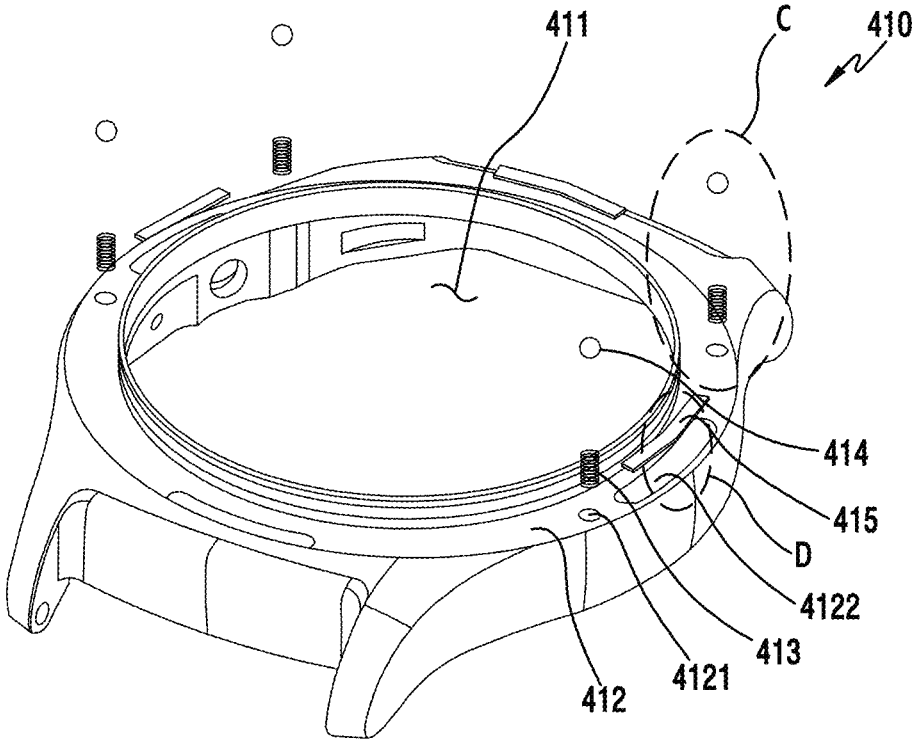
FIG. 7 is an exploded perspective view illustrating the ball which is to be installed in the housing according to various example embodiments of the present disclosure.

FIG. 7 is an exploded perspective view illustrating an example of the ball which is to be installed in the housing according to various example embodiments of the present disclosure.

Referring to FIG. 7, the housing 410 may include the circular first surface 412 formed along the border of the opening 411. According to an example embodiment, the hole 4121 may be disposed on the first surface 412 to receive at least one elastic structure. According to an example embodiment, the elastic structure may be arranged at four locations at regular intervals along the first surface 412, but this should not be considered as limiting. According to an example embodiment, the elastic structure may include the spring member 413 which is inserted into the hole 4121, and the ball 414 which is inserted into at least a part of the hole 4121 from the upper portion of the spring member 413 and is pressed toward the outside by the spring member 413. According to an example embodiment, the ball 414 may be formed of metal or ceramic, and the ball 414 pressed by the spring member 415 may press the second surface 423 (see FIG. 5B) (for example, the bottom surface) of the annular member disposed on the top of the housing 410 toward the outside.

According to various example embodiments, at least one spacer 415 may be disposed on the first surface 412 of the housing 410, avoiding the elastic structure. According to an example embodiment, the spacer 415 may prevent the annular member disposed on the top of the housing 410 and the first surface 412 of the housing 410 from being brought into contact with each other, and thereby may remove the friction between the annular member and the housing 410. According to an example embodiment, the spacer 415 may be formed of Teflon, synthetic resin, or the like, and may perform a lubrication action. According to an example embodiment, when the annular member 420 is rotated, the spacer 415 may serve to remove a foreign substance attached to the second surface of the annular member (for example, particles or the like generated by the friction between the ball and the annular member of metal).

Figure 8A:
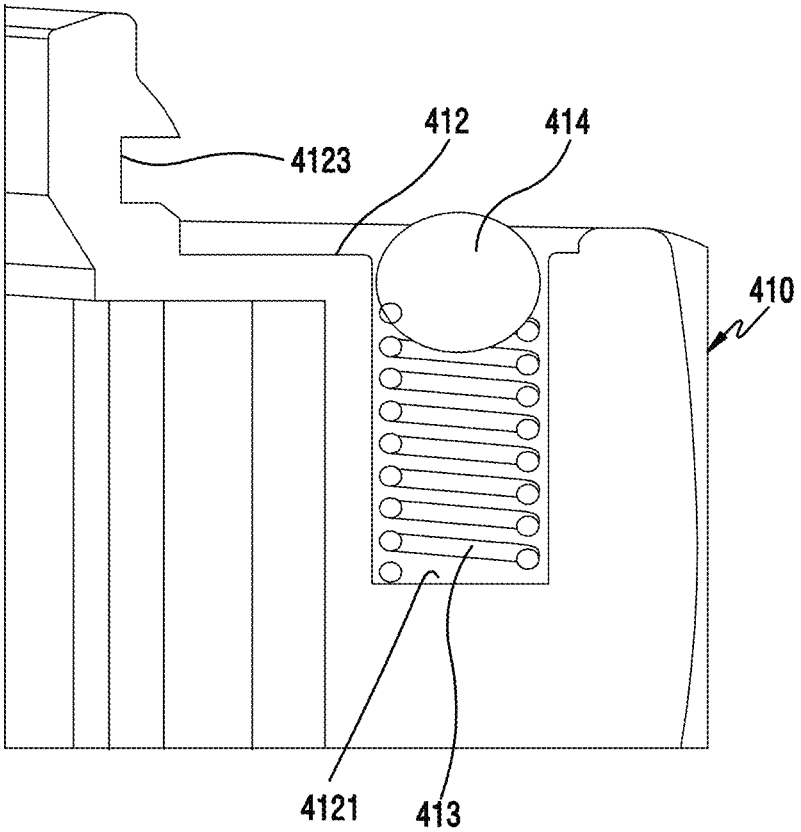
FIG. 8A is a main part cross section view illustrating the ball which is installed in the housing according to various example embodiments of the present disclosure.
Figure 8B:
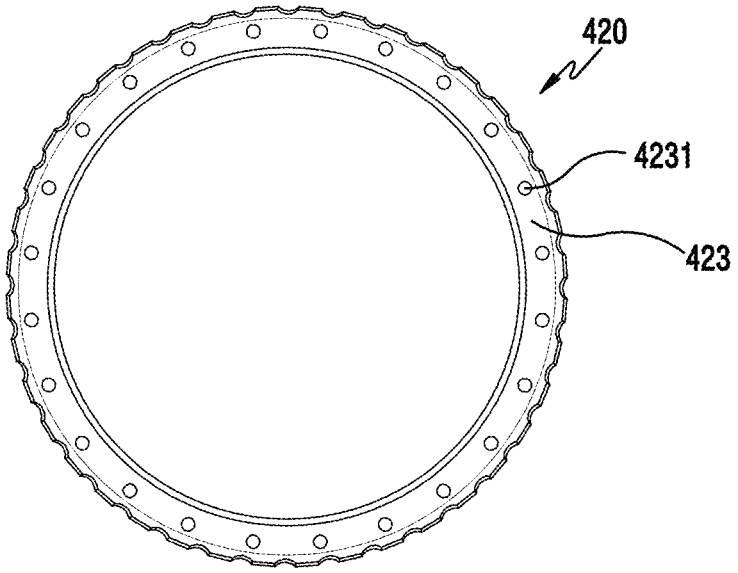
FIG. 8B is a diagram illustrating an example second surface of the annular member according to various example embodiments of the present disclosure.
Figure 8C:
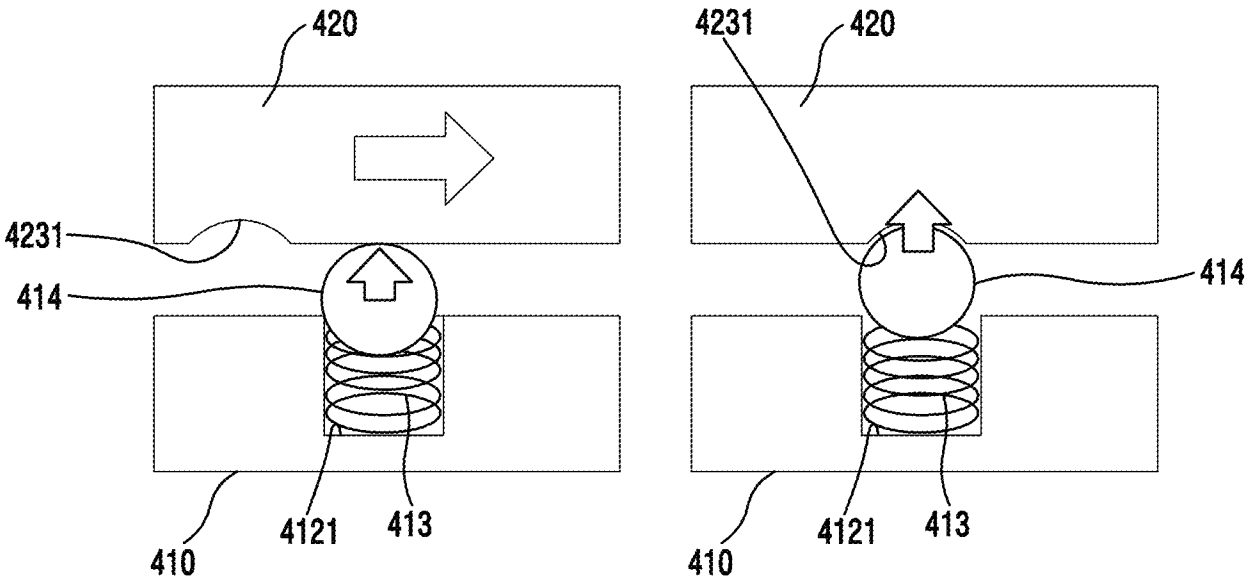
FIG. 8C is a diagram illustrating an example state in which a click sense is provided by the ball according to the rotation of the annular member according to various example embodiments of the present disclosure.

FIG. 8A is a main part cross section diagram illustrating an example of the ball which is installed in the housing according to various example embodiments of the present disclosure. FIG. 8A illustrates a view showing a state in which the elastic structure of FIG. 7 (C of FIG. 7) is disposed in the housing. FIG. 8B is a diagram illustrating an example of the second surface of the annular member according to various example embodiments of the present disclosure. FIG. 8C is a diagram illustrating an example state in which the click sense is provided by the ball according to the rotation of the annular member according to various example embodiments of the present disclosure.

Referring to FIGS. 8A to 8C, the housing 410 may include the plurality of holes 4121 which are arranged on the first surface 412 at regular intervals and have a predetermined depth. According to an example embodiment, the spring member 413 may be inserted into each of the plurality of holes 4121, and the ball 414 may be inserted into the upper portion of each of the holes 4121. According to an example embodiment, the ball 414 may be disposed to have at least a part thereof protrude upwardly from the hole 4121.

According to various example embodiments, when the annular member 420 is rotatably installed on the housing 410 due to the interface, a part of the ball 414 may be selectively seated in the plurality of stop holes 4231, which are arranged on the second surface 423 of the annular member 420 at regular intervals, according to the rotation of the annular member 420. According to an example embodiment, the ball 414 may provide the click sense to the user (for example, the user may feel resistance during a rotation or may feel that the rotation is stopped) every time a part of the ball 414 is seated in the stop hole 4231 according to the rotation of the annular member 420.

According to various example embodiments, due to the reciprocating motion of the ball 414, the ball 414 is inserted into the stop hole 4231 of the annular member 420 and then leaves the stop hole 4231 and is brought into contact with the second surface 423 again, and, as the annular member 420 is continuously rotated, the ball 414 repeats the operation of being inserted into the neighbor stop hole 4231 and thereby provides the clock sense to the user.

Figure 9A:
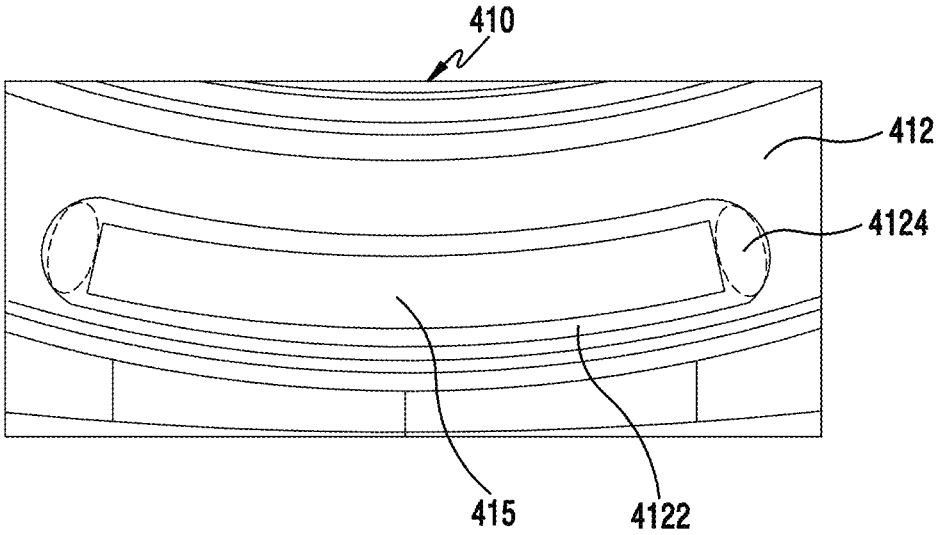
FIGS. 9A, 9B and 9C are diagrams illustrating the spacer which is disposed in the housing according to various example embodiments of the present disclosure.
Figure 9B:
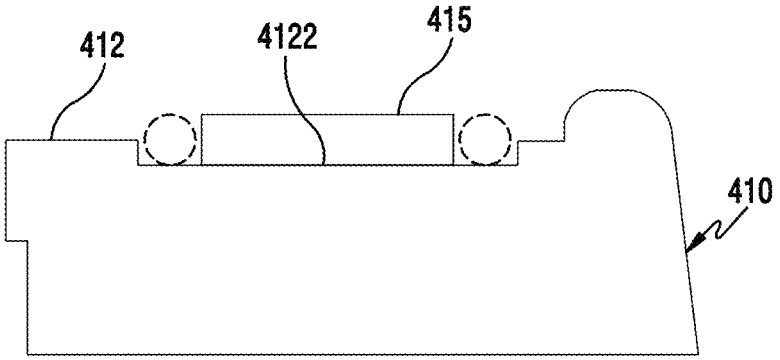
Figure 9C:
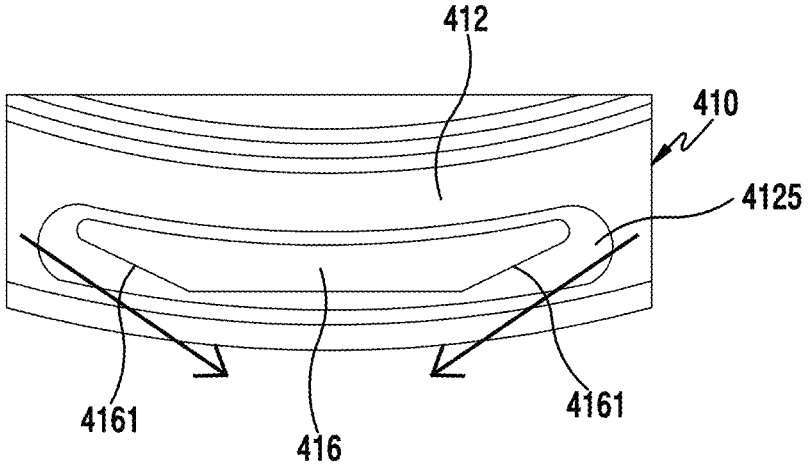

FIGS. 9A, 9B and 9C are diagrams illustrating examples of the spacer which is disposed in the housing according to various example embodiments of the present disclosure. FIGS. 9A to 9C illustrate views showing the spacer of FIG. 7 (D of FIG. 7) which is disposed in the housing.

Referring to FIGS. 9A and 9B, a spacer mounting part 4122 may be formed on the first surface 412 of the housing 410. According to an example embodiment, the spacer mounting part 4122 may be formed to have an area larger than at least the area of the spacer 415. According to an example embodiment, the spacer mounting part 4122 may be formed to be lower than at least the first surface 412 of the housing 410. According to an example embodiment, the top surface of the spacer 415 mounted in the spacer mounting part 4122 may be higher than at least the first surface 412. According to an example embodiment, when the spacer 415 is installed in the spacer mounting part 4122, a margin area 4124 may be formed in an arc direction. According to an example embodiment, the margin area 4124 may be formed at both ends of the spacer 415 mounted in the spacer mounting part 4122. According to an example embodiment, the margin area 424 may be formed to be lower than at least the first surface of the housing.

According to various example embodiments, when the annular member 420 is rotated, the spacer 415 may serve to remove a foreign substance (for example, particles or the like generated by friction between the ball and the annular member of metal) which is attached to the second surface 423 of the annular member 420. According to an example embodiment, the foreign substance swept by the spacer 415 may be removed by being stacked on the margin area 4124 formed in the spacer mounting part 4122 of the housing 410 along the rotation direction of the annular member. Accordingly, since there is no foreign substance in the rotation trajectory where the spacer 415 and the annular member are brought into contact with each other, a smooth rotation of the annular member can be ensured.

Referring to FIG. 9C, a spacer mounting part 4125 may be disposed on the first surface 412 of the housing 410 to mount the spacer 416 therein. According to an example embodiment, the spacer mounting part 4125 may be formed to be lower than at least the first surface 412 of the housing 410. According to an example embodiment, the spacer 416 may be formed to have inclined surfaces 4161 which externally incline toward the center from both ends of the spacer 416. According to an example embodiment, the foreign substance swept by the spacer 416 may be guided in the arrow directions of FIG. 9C due to the inclined surfaces 4161 and discharged to the outside.

Figure 10A:
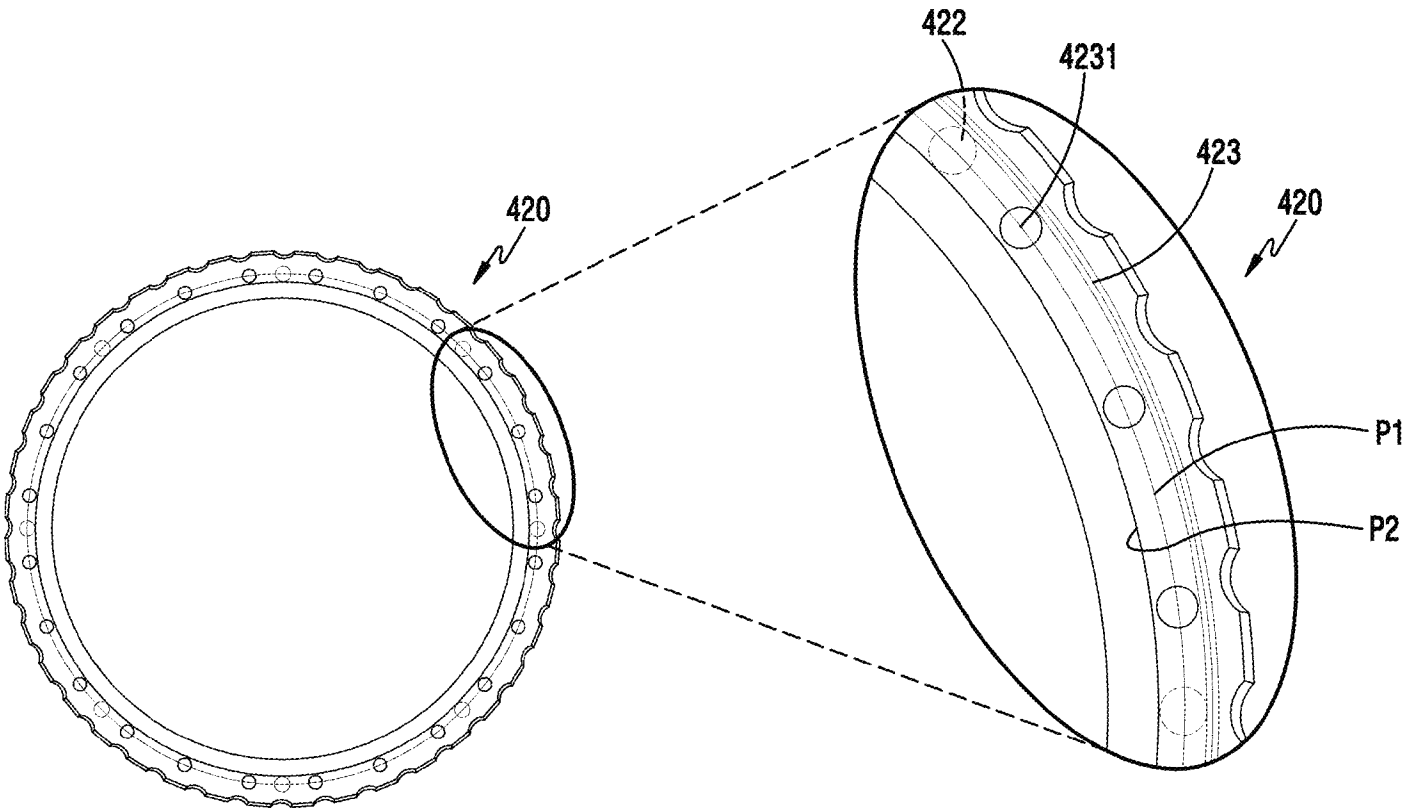
FIGS. 10A and 10B are diagrams illustrating the ball and the magnetic element which are installed according to various example embodiments of the present disclosure.
Figure 10B:
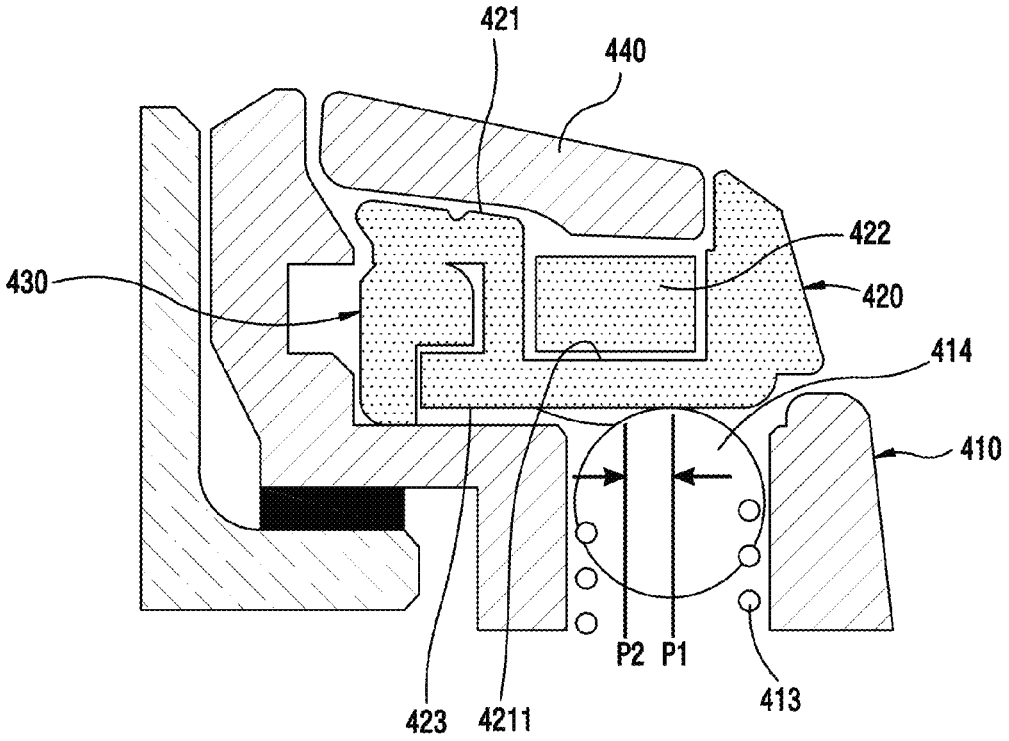

FIGS. 10A and 10B are diagrams illustrating examples of the ball and the magnetic elements which are installed according to various example embodiments of the present disclosure.

Referring to FIGS. 10A and 10B, the annular member 420 rotatably installed on the housing 410 may include the stop holes 4231 formed on the second surface 423 thereof, facing the first surface 412 of the housing 410, at regular intervals, for selectively mounting the ball 414 of the elastic structure therein. According to an example embodiment, the plurality of stop holes 4231 may be arranged on the same first trajectory in a circumferential direction of the annular member 420. According to an example embodiment, the magnetic elements 422 arranged on the first surface 421 of the annular member 420 may also be arranged on the same second trajectory in the circumferential direction of the annular member 420. According to an example embodiment, the first trajectory and the second trajectory may be formed on different locations. This is to collect the particles, which are generated by friction between the ball 414 and the second surface 423 of the annular member 420 when the annular member 420 is rotated on the housing 410, with reference to the center line (P2) of the magnetic element of the second surface 423 of the annular member 420 due to the magnetic element 422, and to prevent a contact motion between the ball 414 and the second surface 423 of the annular member 420 from being interfered by the collected particles in advance. Accordingly, the center line (P1) of the ball 414 which is brought into contact with the annular member 420, and the center line (P2) of the magnetic element 422 disposed in the annular member 420 may be arranged not to be consistent with each other, and it is advantageous to place the two center lines (P1 and P2) further apart.

Figure 11A:
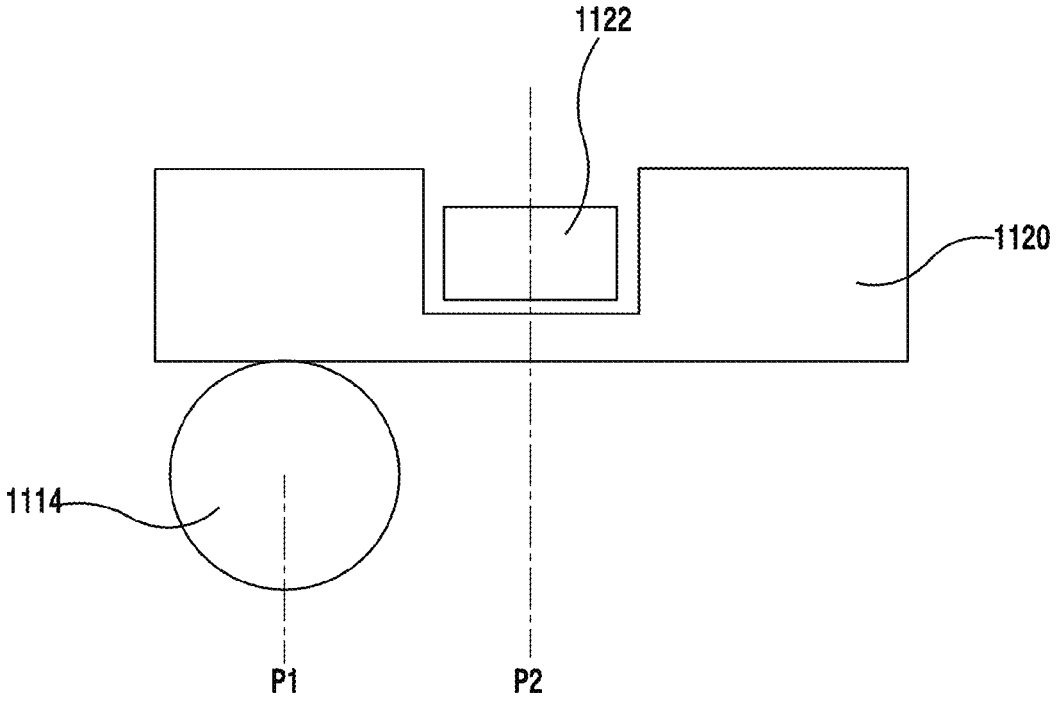
FIGS. 11A, 11B, 12A and 12B are diagrams illustrating an example arrangement relationship of a ball and a magnetic element according to various example embodiments of the present disclosure.
Figure 11B:
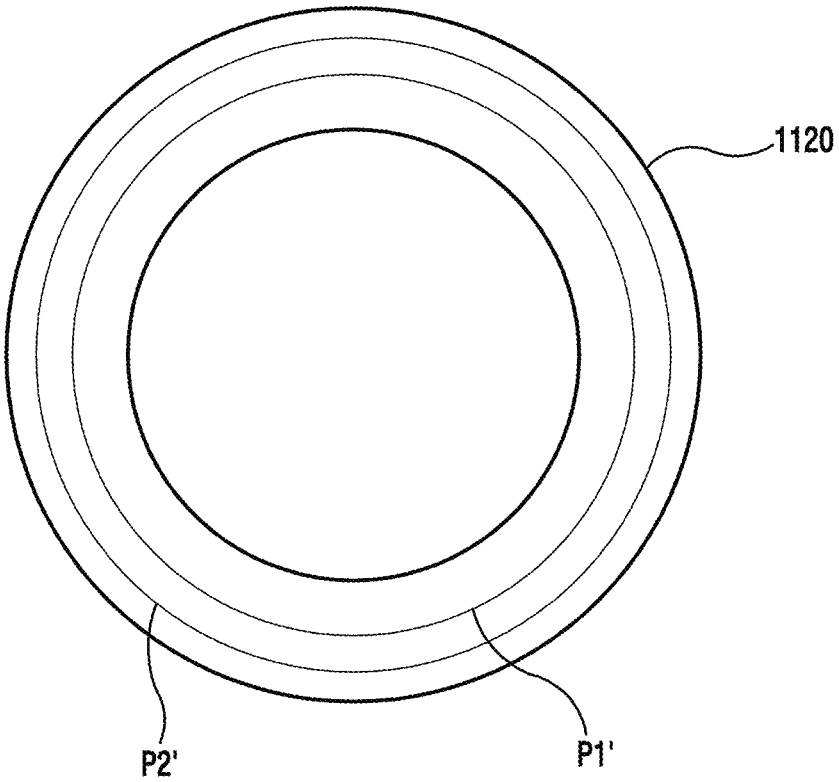

FIGS. 11A and 11B are diagrams illustrating an example arrangement relationship of a ball and a magnetic element according to various example embodiments of the present disclosure.

The annular member 1120 and the ball 1114 of FIGS. 11A and 11B may be similar to the housing 410 and the ball 414 of FIG. 4 or may be another embodiment of the annular member and the ball.

Referring to FIGS. 11A and 11B, the center line P1 of the ball 1114 which is brought into contact with the bottom surface of the annular member 1120 may be located on the left with reference to the center line of the magnetic element 1122 disposed in the annular member 1120. According to an example embodiment, in this case, the annular member 1120 may be configured such that the contact trajectory (P1') of the ball 1114, arranged in the circumferential direction, with the annular member 1120 has a smaller diameter than that of the moving trajectory (P2') of the magnetic element 1122.

Figure 12A:
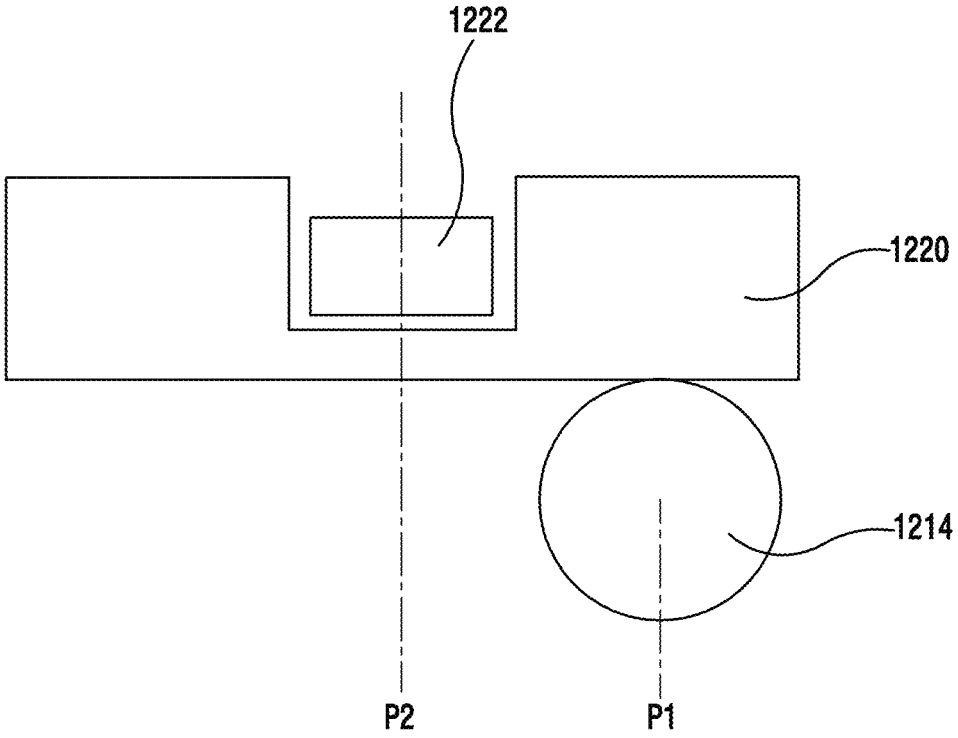
Figure 12B:
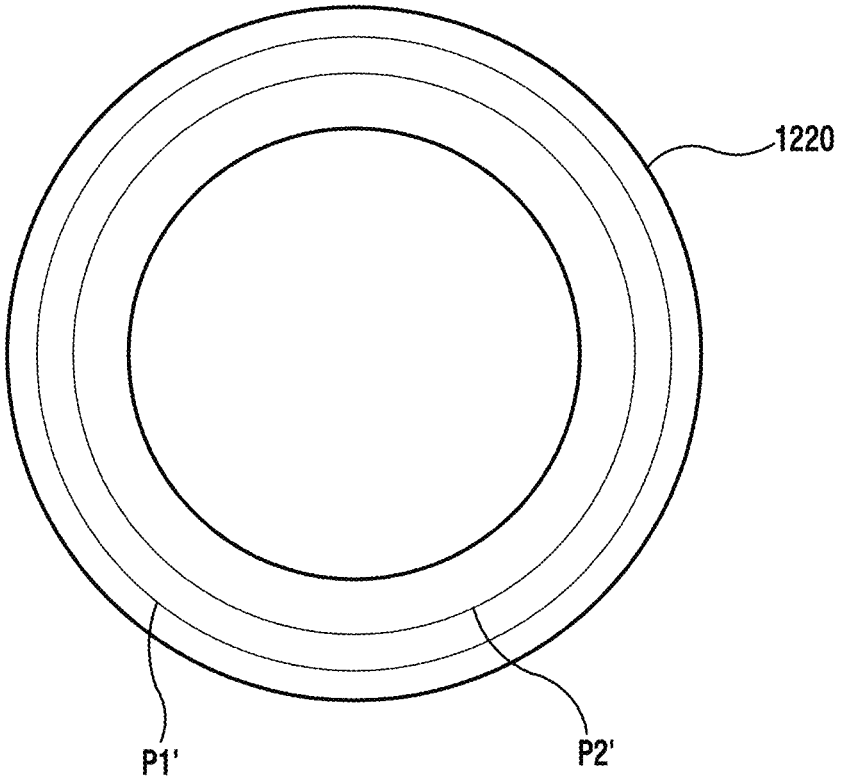

FIGS. 12A and 12B are diagrams illustrating an example arrangement relationship of a ball and a magnetic element according to various example embodiments of the present disclosure.

The annular member 1220 and the ball 1214 of FIGS. 12A and 12B may be similar to the housing 410 and the ball 414 of FIG. 4 or may be another embodiment of the annular member and the ball.

Referring to FIGS. 12A and 12B, the center line P1 of the ball 1214 which is brought into contact with the bottom surface of the annular member 1220 may be located on the right with reference to the center line of the magnetic element 1222 disposed in the annular member 1220. According to an example embodiment, in this case, the annular member 1220 may be configured such that the contact trajectory (P1') of the ball 1214, arranged in the circumferential direction, with the annular member 1220 has a larger diameter than that of the moving trajectory (P2') of the magnetic element 1222.

Figure 13A:
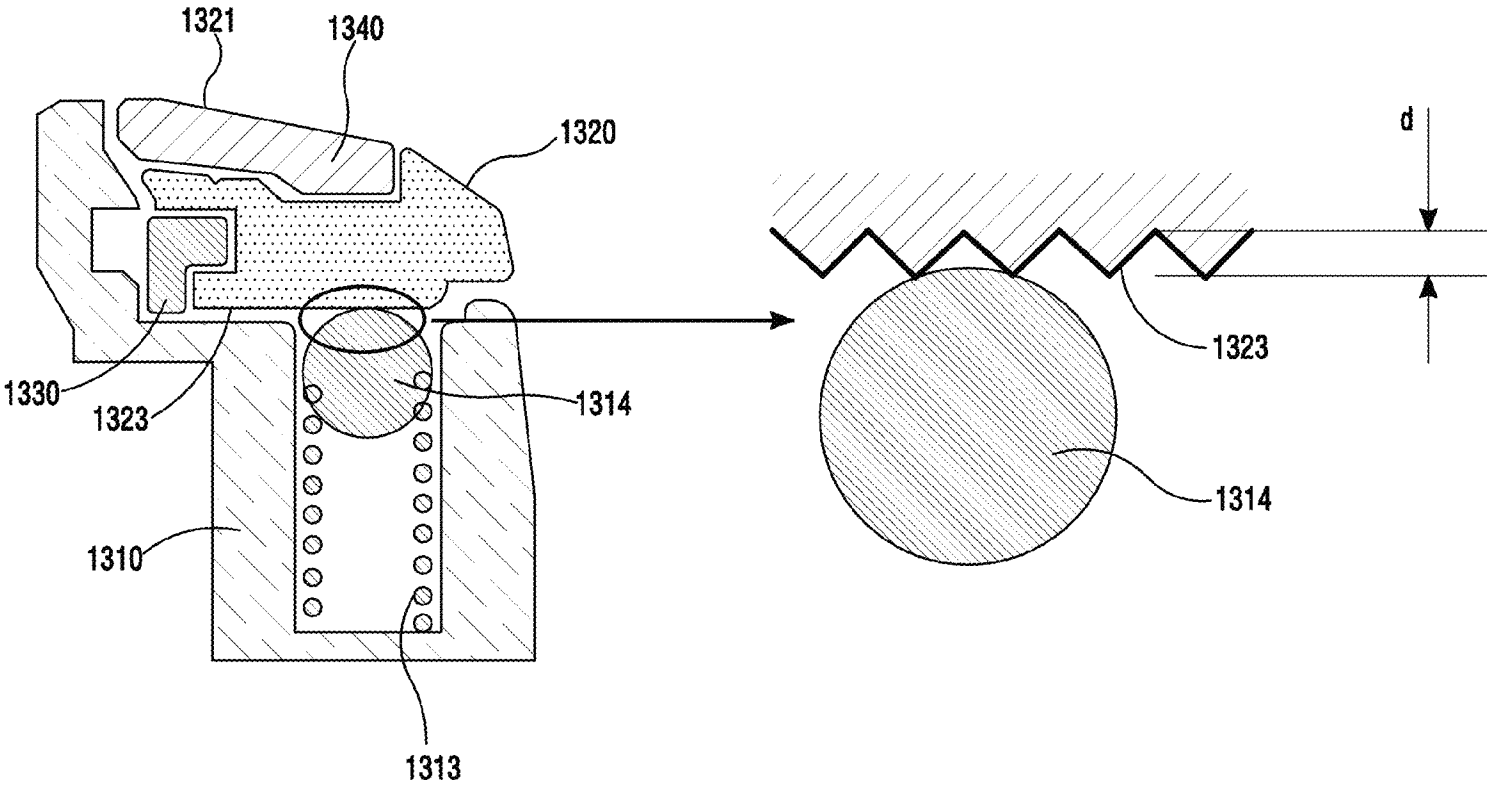
FIGS. 13A and 13B are diagrams illustrating an example shape of a contact surface of an annular member which is brought into contact with a ball according to various example embodiments of the present disclosure.
Figure 13B:
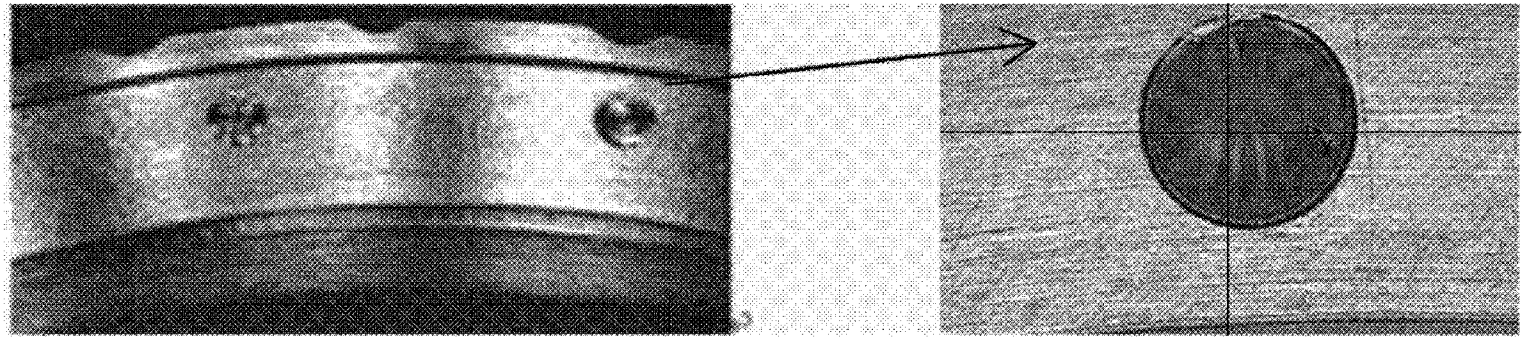

FIGS. 13A and 13B are diagrams illustrating an example shape of a contact surface of an annular member which is brought into contact with a ball according to various example embodiments of the present disclosure.

The annular member 1320 and a ball 1314 of FIG. 13A may be similar to the housing 410 and the ball 414 of FIG. 4 or may be another embodiment of the annular member and the ball.

Referring to FIGS. 13A and 13B, the annular member 1320 may be rotatably disposed on a housing 1310 via an interface 1330. According to an example embodiment, the annular member 1320 may include a decoration member 1340 disposed on the top surface thereof. According to an example embodiment, a second surface 1323 of the annular member 1320 may include a spring member 1313 which is disposed in the housing 1310 and the ball 1314 which is pressed toward the second surface 1323 of the annular member 1320 by the spring member 1313, and, when the annular member 1320 is rotated, the second surface 1323 of the annular member 1320 may be brought into contact with the ball 1314.

According to various example embodiments, as a contact surface of the annular member 1320 brought into contact with the ball 1314 is larger, more particles may be generated by friction. Therefore, it is advantageous to reduce the contact surface between the ball 1314 and the annular member 1320. According to an example embodiment, the annular member 1320 may be formed of metal and the second surface 1323 brought into contact with the ball 1314 may form a hairline in the circumferential direction. According to an example embodiment, the hairline may be formed by a spin process. Accordingly, a protrusion having a predetermined depth (d) may be alternately formed on the second surface 1323 of the annular member 1320 in the circumferential direction, and the outer circumference of the ball 1314 may be brought into contact with the end of the corresponding protrusion formed in the hairline. Therefore, since the path that the ball 1314 follows is pre-set, an unnecessary abrasion generation process can be reduced during a ball path establishing process, which may initially occur when the product is used for the first time, and thus particles can be prevented.

Figure 14:
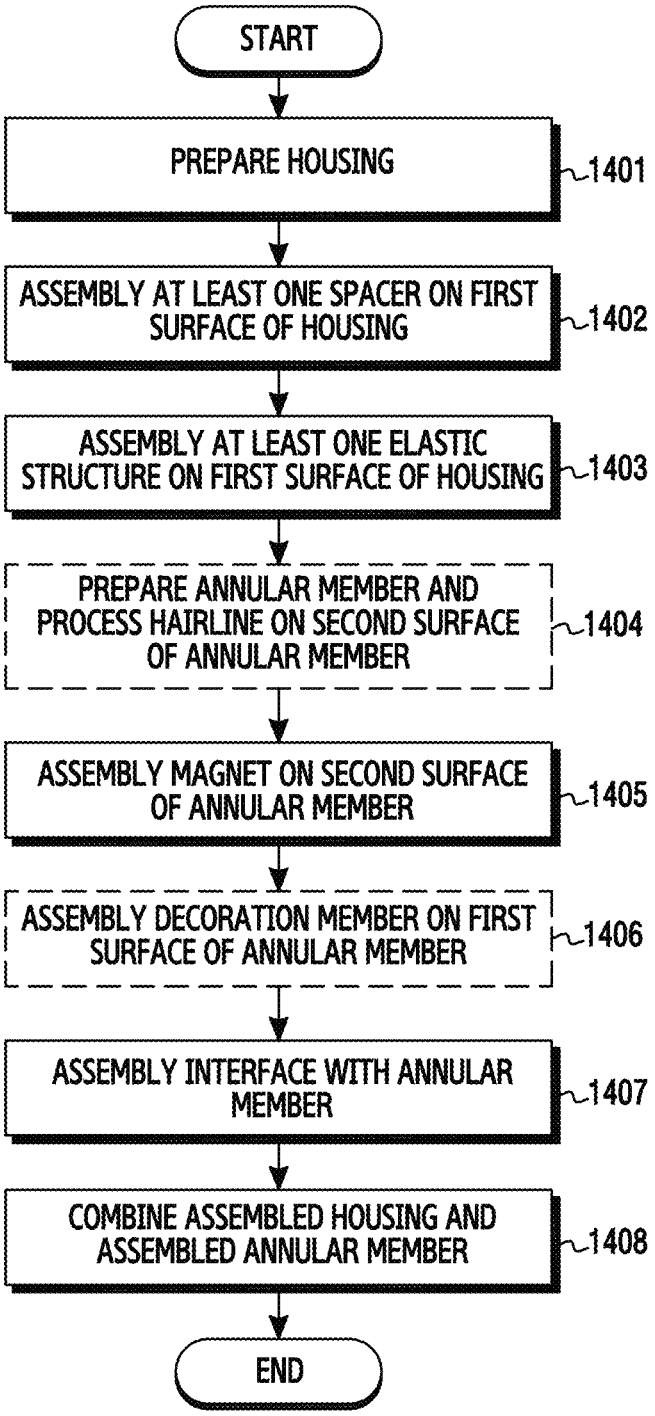
FIG. 14 is a flowchart illustrating an example process of assembling of an electronic device according to various example embodiments of the present disclosure.

FIG. 14 is a flowchart illustrating an example assembly process of an electronic device according to various example embodiments of the present disclosure. FIG. 14 will be described below with reference to FIGS. 4A to 5C.

In operation 1401, the housing 410 may be prepared. According to an example embodiment, the housing 410 may be formed to have the substantially circular opening 411. According to an example embodiment, the circular first surface 412 may be formed along the border of the opening 411 of the housing 410. According to an example embodiment, the spacer mounting part 4122 for mounting the spacer 415 therein may be formed on the first surface 412 of the housing, and the hole 4121 for inserting the elastic structure thereinto may be formed on the first surface 412 of the housing, avoiding the spacer mounting part 4122.

In operation 1402, at least one spacer 415 may be assembled on the first surface 412 of the housing 410. According to an example embodiment, the spacer 415 may prevent the annular member 420 and the first surface 412 of the housing 410 from being brought into contact with each other and thereby may remove friction between the annular member 420 and the housing 410. According to an example embodiment, the spacer 415 may be formed of Teflon, synthetic resin, or the like, and may perform a lubrication action. According to an example embodiment, when the annular member 420 is rotated, the spacer 415 may serve to remove a foreign substance (for example, particles or the like generated by friction between the ball and the annular member of metal) which is attached to the second surface 423 of the annular member 420.

In operation 1403, at least one elastic structure may be assembled in the first surface 412 of the housing 410. According to an example embodiment, the elastic structure may include the spring member 413 which is inserted into the hole 4121, and the ball 414 which is inserted into at least a part of the hole 4121 from the upper portion of the spring member 413 and is pressed toward the outside by the spring member 413. According to an example embodiment, the ball 414 may be formed of metal or ceramic, and the ball 414 pressed by the spring member 413 may press the second surface 423 of the annular member 420 disposed on the top of the housing 410 toward the outside.

In operation 1404, the annular member 420 to be rotatably assembled with the housing 410 may be prepared. According to an example embodiment, the second surface 423 of the annular member 420 to be brought into contact with the ball 414 may have a hairline processed to minimize and/or reduce a contact surface and thus prevent and/or reduce particles from being generated by friction between the ball and the annular member. According to an example embodiment, the hairline may be formed through a spin process. According to an example embodiment, operation 1404 of generating the hairline through the spin process may be omitted.

In operation 1405, the magnetic element 422 may be assembled on the first surface 421 of the annular member 420. According to an example embodiment, the magnetic element 422 may be inserted into and fixed to the mounting recess 4211 formed on the first surface 421 to be flush with the first surface 421 of the annular member 420. According to an example embodiment, a plurality of magnetic elements 422 may be arranged along the first surface 421 of the annular member 420 at regular intervals.

In operation 1406, the decoration member 440 may be assembled on the first surface 421 of the annular member 420. According to an example embodiment, the decoration member 440 may be formed of synthetic resin which is plated with chrome or formed of metal (for example, SUS or the like). According to an example embodiment, the decoration member 440 may be fixed to the first surface 421 of the annular member 420, and may be formed to have its top surface coated with a paint or imprinted, and thus may be used as an indicator element for making the rotation parameter of the annular member 420 recognized by the user. According to an example embodiment, operation 1406 of assembling the decoration member 440 may be omitted.

In operation 1407, the interface may be assembled with the annular member. According to an example embodiment, the annular member 420 may include the guide recess 424 formed on one side thereof, and the guide rib 431 protruding from one side of the interface 430 may be seated in the guide recess 424, such that the annular member is installed to be rotatable on the interface 430.

In operation 1408, the housing 410 assembled in operations 1401 to 1404 and the annular member assembled in operations 1405 to 1407 may be combined with each other. According to an example embodiment, the interface 430 may include the locking projection 432 protruding from the other side thereof toward the center of the housing 410, and the interface 430 may be fixed to the housing 410 in such a way that the locking projection 432 is locked into the locking recess formed along the border of the housing 410. Accordingly, the interface 430 may be fixed to the housing 410 and may have the annular member 420 installed on the housing 410 to be rotatable without deviating from the housing 410. According to various example embodiments, the annular member 420 may be guided by the interface, which serves as a lubrication member, and smoothly rotated.

According to various example embodiments, the annular member assembled first by operations 1405 to 1407 may be assembled with the housing assembled by operations 1401 to 1404. According to an example embodiment, after the above-described operations, a connection member or wearing structure configured to enable the electronic device to be worn on a user's body may be assembled with at least a part of the housing assembled with the annular member.

According to various example embodiments, there is provided an electronic device including a rotatable annular member, which can provide high operation reliability (good rotation sense and click sense) to the user even when it is used for long time.

According to various example embodiments, an electronic device may include: a housing which includes a substantially circular opening and a first surface facing in a first direction; a wearing structure configured to enable the electronic device to be removably worn on a part of a human body and connected to the housing; a display disposed in the opening; an annular member installed on the first surface of the housing and configured to be rotatable along a periphery of the opening, the annular member including a second surface facing in a second direction opposite to the first direction; at least one spacer which is interposed between a part of the first surface of the housing and the second surface of the annular member; and a circuit configured to detect a rotation of the annular member and to change the display at least in part based on the rotation.

According to various example embodiments, the at least one spacer may be extended along a part of the periphery of the opening.

According to various example embodiments, the at least one spacer may be connected to the first surface rather than the second surface.

According to various example embodiments, the annular member may include at least one magnetic element.

According to various example embodiments, the first surface of the housing may include at least one hole and at least one elastic structure may be received in the hole in part, and the at least one elastic structure may be pressed against the second surface.

According to various example embodiments, the elastic structure may include a ball and a spring member which presses the ball against the second surface.

According to various example embodiments, the magnetic member may be disposed to be offset from the center of the ball in a radial direction extending toward the periphery of the opening from the center of the opening.

According to various example embodiments, the elastic structure and the spacer may be spaced from each other.

According to various example embodiments, a hairline may be formed on the second surface of the annular member, the hairline configured to be brought into contact with the ball, in a circumferential direction in order to reduce a contact surface with the ball.

According to various example embodiments, the second surface of the annular member, which is brought into contact with the ball, may include a plurality of stop holes arranged at regular intervals in a circumferential direction, and the ball may be selectively inserted into each of the stop holes based on the rotation of the annular member, and configured to provide a click sense based on the rotation of the annular member.

According to various example embodiments, the electronic device may further include an interface which is disposed between the housing and the annular member.

According to various example embodiments, the interface may be fixed to the housing and be configured to regulate the annular member to be rotatable while controlling a deviation of the annular member.

According to various example embodiments, the interface may include at least one locking projection protruding from at least a part of the interface toward the opening, and the interface may be fixed so that the locking projection is configured to be locked into a locking recess formed along the periphery of the opening.

According to various example embodiments, when the interface includes at least one guide rib protruding from at least a part of the interface in a direction opposite to the opening, the interface may rotate the annular member so that the guide rib is seated in a guide recess formed on a corresponding location of the annular member.

According to various example embodiments, the housing may include a spacer mounting part formed on the first surface of the housing, and the spacer mounting part may be lower than the first surface and may have an area larger than that of the spacer.

According to various example embodiments, a margin area of the spacer mounting part which is formed after the spacer is mounted may be used as a space for collecting particles generated by the rotation of the annular member.

According to various example embodiments, the spacer may include inclined surfaces which externally incline toward the center from both ends of the spacer, and the collected particles may be discharged to the outside of the housing by the inclined surfaces.

According to various example embodiments, the spacer may be formed of Teflon.

According to various example embodiments, the electronic device may include a watch type wearable electronic device which is worn on a user's wrist.

According to various example embodiments, an electronic device may include: a housing which includes a substantially circular opening and a first surface facing in a first direction; an annular member installed on the first surface and configured to be rotatable along a periphery of the opening, the annular member including a second surface facing in a second direction opposite to the first direction; an interface fixed along the periphery of the opening of the housing and configured to regulate the annular member to be rotatable; at least one spacer which is fixed to a part of the first surface of the housing and is brought into contact with the second surface of the annular member; a plurality of magnetic elements which face the second surface and are arranged at regular intervals along a first surface of the annular member facing in the first direction; a sensor disposed in the opening of the housing and configured to detect a magnetic force of the magnetic element based on a rotation of the annular member; and at least one processor functionally connected with the sensor, and configured to output a corresponding function based on a rotation parameter which is provided by the sensor and detected based on the rotation of the annular member.

The various example embodiments disclosed in the present disclosure and drawings are provided to aid in understanding and explanation of the technical features of the disclosure, and are not intended to limit the scope of the present disclosure. Therefore, the scope of the present disclosure is defined not by the detailed description of the disclosure but by the appended claims, and all differences within the scope should be construed as being included in the present disclosure.

What is claimed is:

1. An electronic device comprising:

a housing comprising an opening and a first surface facing in a first direction;

a wearing structure configured to enable the electronic device to be removably worn on a part of a human body and connected to the housing;

a display disposed in the opening;

an annulus installed on the first surface of the housing and configured to be rotatable along a periphery of the opening, the annulus comprising a second surface facing a second direction opposite the first direction;

at least one spacer interposed between a part of the first surface of the housing and the second surface of the annulus; and a circuit configured to detect a rotation of the annulus and to change a function of the display at least in part based on the rotation of the annulus, wherein the housing comprises a spacer mounting region formed on the first surface of the housing, wherein the spacer mounting region is recessed from the first surface and has an area larger than an area of the spacer.

2. The electronic device of claim 1, wherein the at least one spacer extends along a part of the periphery of the opening.

3. The electronic device of claim 1, wherein the at least one spacer is connected to the first surface of the housing.

4. The electronic device of claim 1, wherein the annulus comprises at least one magnetic element.

5. The electronic device of claim 4, wherein the first surface of the housing comprises at least one hole and at least one elastic structure at least partially received in the hole, and the at least one elastic structure is configured to be pressed against the second surface of the annulus.

6. The electronic device of claim 5, wherein the elastic structure comprises a ball and a spring configured to press the ball against the second surface of the annulus.

7. The electronic device of claim 6, wherein the magnetic element is disposed to be offset from the center of the ball in a radial direction extending toward the periphery of the opening from a center of the opening.

8. The electronic device of claim 5, wherein the elastic structure and the spacer are spaced from each other.

9. The electronic device of claim 6, wherein a hairline is formed on the second surface of the annulus, and is configured to be brought into contact with the ball in a circumferential direction.

10. The electronic device of claim 6, wherein the second surface of the annulus, which is brought into contact with the ball, comprises a plurality of stop holes arranged at regular intervals in a circumferential direction, and the ball is configured to be selectively insertable into each of the stop holes based on the rotation of the annulus to provide a click sense based on the rotation of the annular member.

11. The electronic device of claim 1, further comprising an interface disposed between the housing and the annulus.

12. The electronic device of claim 11, wherein the interface is fixed to the housing and is configured to regulate the rotation of the annulus and to control a deviation of the annulus.

13. The electronic device of claim 12, wherein the interface comprises at least one locking projection protruding from at least a part of the interface toward the opening, and the interface is fixed such that the locking projection is configured to be locked into a locking recess formed along the periphery of the opening.

14. The electronic device of claim 12, wherein, the interface comprises at least one guide rib protruding from at least a part of the interface in a direction opposite to the opening, and the interface is configured to rotate the annulus such that the guide rib is seated in a guide recess formed on a corresponding location of the annulus.

15. The electronic device of claim 1, wherein a margin area of the spacer mounting region is formed after the spacer is mounted and is configured to collect particles moved by the rotation of the annulus.

16. The electronic device of claim 15, wherein the spacer comprises inclined surfaces inclining externally toward a center from both ends of the spacer, and wherein the inclined surfaces are configured to discharge collected particles to the outside of the housing.

17. The electronic device of claim 1, wherein the spacer comprises Teflon.

18. The electronic device of claim 1, wherein the electronic device comprises a watch type wearable electronic device which is wearable on a wrist.

19. An electronic device comprising:

a housing comprising an opening and a first surface facing in a first direction;

an annulus installed on the first surface of the housing and configured to be rotatable along a periphery of the opening, the annulus comprising a second surface facing a second direction opposite the first direction;

an interface fixed along the periphery of the opening of the housing and configured to regulate the annulus to be rotatable;

at least one spacer fixed to a part of the first surface and in contact with the second surface of the annulus;

a plurality of magnetic elements arranged at regular intervals along a first surface of the annular member facing in the first direction;

a sensor module comprising at least one sensor which is disposed in the opening of the housing and configured to detect a magnetic force of the magnetic element based on a rotation of the annulus; and at least one processor functionally connected with the sensor module, and configured to output a corresponding function based on a rotation parameter provided by the sensor module and detected based on the rotation of the annulus member, wherein the housing comprises a spacer mounting region formed on the first surface of the housing, wherein the spacer mounting region is recessed from the first surface and has an area larger than an area of the spacer.

* * * * *